US009658558B2

(12) United States Patent
Kudo et al.

(10) Patent No.: US 9,658,558 B2
(45) Date of Patent: May 23, 2017

(54) BLOWER PIPE, BLOWING DEVICE, AND IMAGE FORMING APPARATUS

(75) Inventors: Masafumi Kudo, Kanagawa (JP); Koji Otsuka, Kanagawa (JP); Yuki Nagamori, Kanagawa (JP); Kazuki Inami, Kanagawa (JP); Yasunori Momomura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 1087 days.

(21) Appl. No.: 13/446,725

(22) Filed: Apr. 13, 2012

(65) Prior Publication Data

US 2013/0165036 A1 Jun. 27, 2013

(30) Foreign Application Priority Data

Dec. 27, 2011 (JP) ..... 2011-285454

(51) Int. Cl.
*F24F 13/02* (2006.01)
*G03G 15/02* (2006.01)
*G03G 21/20* (2006.01)

(52) U.S. Cl.
CPC ..... *G03G 15/0291* (2013.01); *G03G 21/206* (2013.01); *G03G 2215/027* (2013.01)

(58) Field of Classification Search
None
See application file for complete search history.

(56) References Cited

U.S. PATENT DOCUMENTS 3,471,695 A * 10/1969 Cranch et al. ..... 361/230
3,862,420 A * 1/1975 Banks et al. ..... 250/324
4,745,282 A * 5/1988 Tagawa et al. ..... 250/326
5,128,720 A * 7/1992 Creveling ..... 399/92
5,742,874 A * 4/1998 Koshimura et al. ..... 399/100
6,308,024 B1 * 10/2001 Nakayama et al. ..... 399/98
6,917,773 B2 * 7/2005 Maeda et al. ..... 399/92
7,585,352 B2 * 9/2009 Dunn ..... 95/73
(Continued)

FOREIGN PATENT DOCUMENTS

JP A-10-198128 7/1998
JP 2006-276175 A 10/2006
(Continued)

OTHER PUBLICATIONS

Sep. 29, 2015 Office Action issued in Japanese Patent Application No. 2011-285454.

*Primary Examiner* — Gregory Huson
*Assistant Examiner* — Martha Becton
(74) *Attorney, Agent, or Firm* — Oliff PLC

(57) ABSTRACT

Provided is a blower pipe with an inlet, an outlet, a passage part formed with a passage space to cause air to flow therein, and suppressing parts that are provided in different parts in a direction in which air in the passage space of the passage part is caused to flow and that suppress the flow of the air, wherein an outlet suppressing part constructed so that the passage space in the outlet is closed by a permeable member dotted with ventilation portions is provided in the outlet of the passage part as one of the suppressing parts, and wherein the permeability of an end region present at least at one end in the lateral direction orthogonal to the longitudinal direction among regions along the longitudinal direction of the opening shape of the outlet is set to a smaller value than the permeability of regions other than the end region.

12 Claims, 22 Drawing Sheets

(56) References Cited

U.S. PATENT DOCUMENTS

| | | | | |
|---|---|---|---|---|
| 7,829,848 | B2 * | 11/2010 | Takada et al. | 250/288 |
| 8,498,548 | B2 * | 7/2013 | Nishikawa et al. | 399/92 |
| 8,759,766 | B2 * | 6/2014 | Momomura et al. | 250/324 |
| 8,824,915 | B2 * | 9/2014 | Makino | 399/92 |
| 8,855,519 | B2 * | 10/2014 | Katahira et al. | 399/92 |
| 2007/0036577 | A1 * | 2/2007 | Okabe et al. | 399/92 |
| 2007/0065170 | A1 * | 3/2007 | Kimura | 399/92 |
| 2008/0063425 | A1 * | 3/2008 | Idehara et al. | 399/93 |
| 2008/0226334 | A1 * | 9/2008 | Ohno et al. | 399/100 |
| 2009/0074463 | A1 * | 3/2009 | Nishio et al. | 399/170 |
| 2010/0025576 | A1 * | 2/2010 | Adams | 250/288 |
| 2010/0213370 | A1 * | 8/2010 | Nakasuji et al. | 250/310 |
| 2011/0121510 | A1 * | 5/2011 | Tsuda et al. | 271/226 |
| 2011/0200350 | A1 | 8/2011 | Kumazawa | |
| 2011/0262176 | A1 | 10/2011 | Yamamoto | |
| 2012/0033379 | A1 * | 2/2012 | Lam et al. | 361/695 |
| 2012/0155913 | A1 * | 6/2012 | Jung | 399/92 |
| 2013/0101309 | A1 * | 4/2013 | Inami et al. | 399/92 |
| 2014/0119767 | A1 * | 5/2014 | Inami et al. | 399/92 |
| 2014/0140718 | A1 * | 5/2014 | Kudo et al. | 399/92 |
| 2015/0110518 | A1 * | 4/2015 | Nagamori et al. | 399/92 |

FOREIGN PATENT DOCUMENTS

| | | | |
|---|---|---|---|
| JP | 2011-158843 | A | 8/2011 |
| JP | 2011-227368 | A | 11/2011 |

* cited by examiner

BLOWER PIPE, BLOWING DEVICE, AND IMAGE FORMING APPARATUS

CROSS-REFERENCE TO RELATED APPLICATIONS

This application is based on and claims priority under 35 USC 119 from Japanese Patent Application No. 2011-285454 filed Dec. 27, 2011.

BACKGROUND (i) Technical Field

The present invention relates to a blower pipe, a blowing device, and an image forming apparatus.

(ii) Related Art

In image forming apparatuses that form an image constituted with developer on a recording paper, for example, there is an image forming apparatus using a corona discharger that performs corona discharge in the process of charging a latent image holding member, such as a photoreceptor, or the process of neutralization, the process of transferring a non-fixed image to the recording paper, or the like.

Additionally, in the corona discharger, in order to prevent unnecessary substances, such as paper debris or a discharge product, from adhering to component parts, such as a discharge wire or a grid electrode, a blowing device that blows air against component parts may also be provided. The blowing device in this case is generally constituted by a blower that sends air, and a duct (blower pipe) that guides and sends out the air sent from the blower up to a target structure, such as a corona discharger.

In the related art, improvements for enabling air to be uniformly blown in the longitudinal direction of the component parts, such as a discharge wire, are variously performed on the blowing device or the like. Particularly, as such a blowing device or the like, there is proposed a blowing device that does not adopt a configuration in which the shape of a passage space of a duct through which air is caused to flow is formed in a special shape or a configuration in which a straightening vane or the like that adjusts the direction in which air flows is installed in the passage space of the duct, or the like, but adopts a separate configuration as illustrated below.

SUMMARY

According to an aspect of the invention, there is provided a blower pipe provided with an inlet that takes in air, and an outlet that is arranged so as to face a portion of a long target structure in a longitudinal direction against which the air taken in from the inlet is to be blown and that has a long opening shape that is parallel to the portion of the target structure in the longitudinal direction and is different from the opening shape of the inlet, the blower pipe including: a passage part formed with a passage space for connecting between the inlet and the outlet to cause air to flow therein; and plural suppressing parts that are provided in different parts in a direction in which air in the passage space of the passage part is caused to flow and that suppress the flow of the air, wherein an outlet suppressing part constructed so that the passage space in the outlet is closed by a permeable member dotted with plural ventilation portions is provided in the outlet of the passage part as one of the plural suppressing parts, and wherein the permeability of an end region present at least at one end in a lateral direction orthogonal to the longitudinal direction among regions along the longitudinal direction of the opening shape of the outlet in the permeable member of the outlet suppressing part is set to a smaller value than the permeability of regions other than the end region.

BRIEF DESCRIPTION OF THE DRAWINGS

Exemplary embodiments of the present invention will be described in detail based on the following figures, wherein:

FIG. 1 is an explanatory view showing the outline of a blower duct and a blowing device and an image forming apparatus using the same related to an exemplary embodiment 1 or the like;

FIG. 10A shows measurement results of the blower duct of a reference standard example, and FIGS. 10B and 10C show the evaluation tests of the blower ducts of respective examples in cases where ventilation holes are not formed to four rows and five rows, respectively;

DETAILED DESCRIPTION

Hereinafter, the modes (hereinafter referred to as "exemplary embodiments") for carrying out the invention will be described in detail with reference to the accompanying drawings.

Exemplary Embodiment 1

Figure 1:
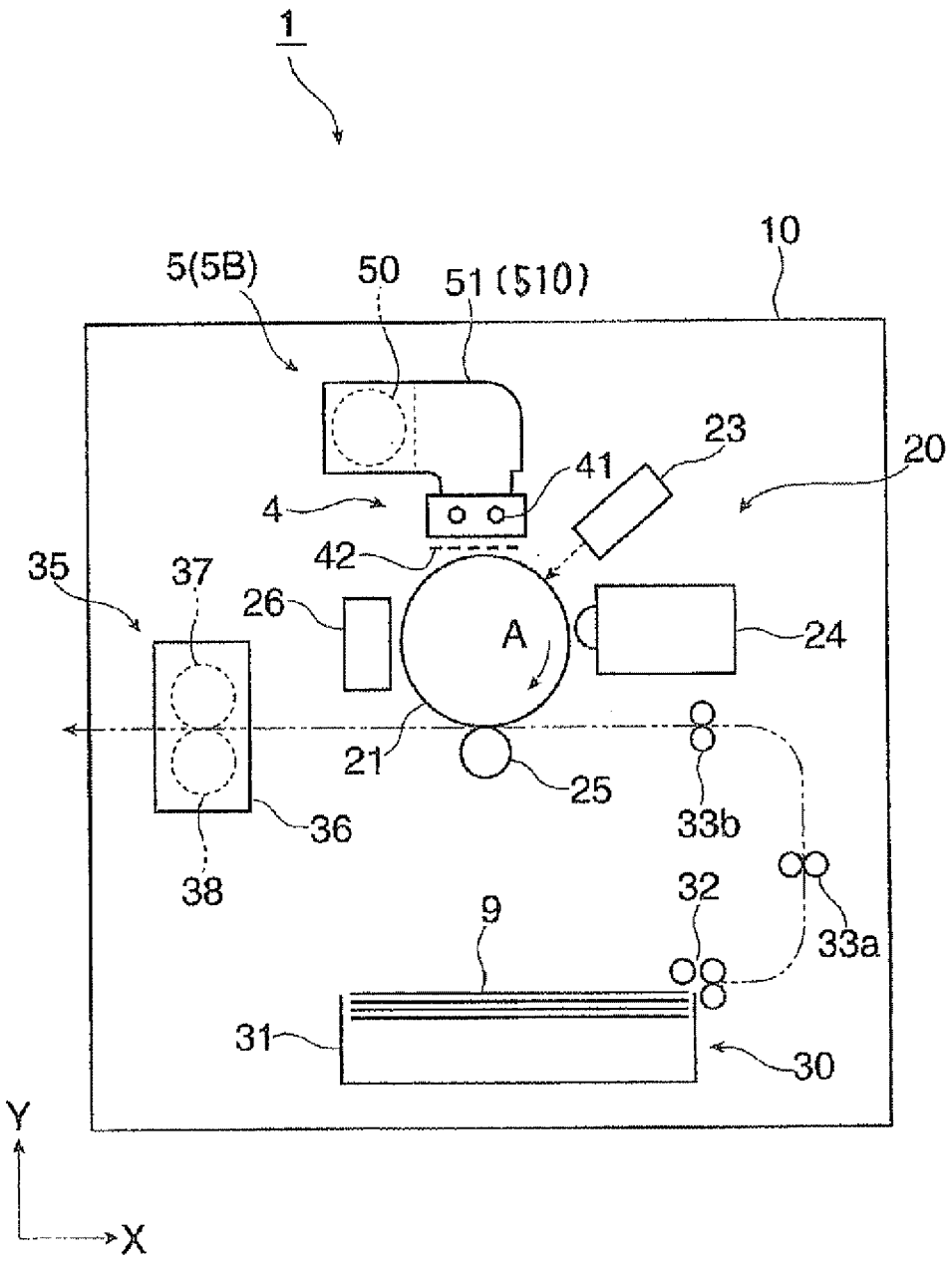
Figure 2:
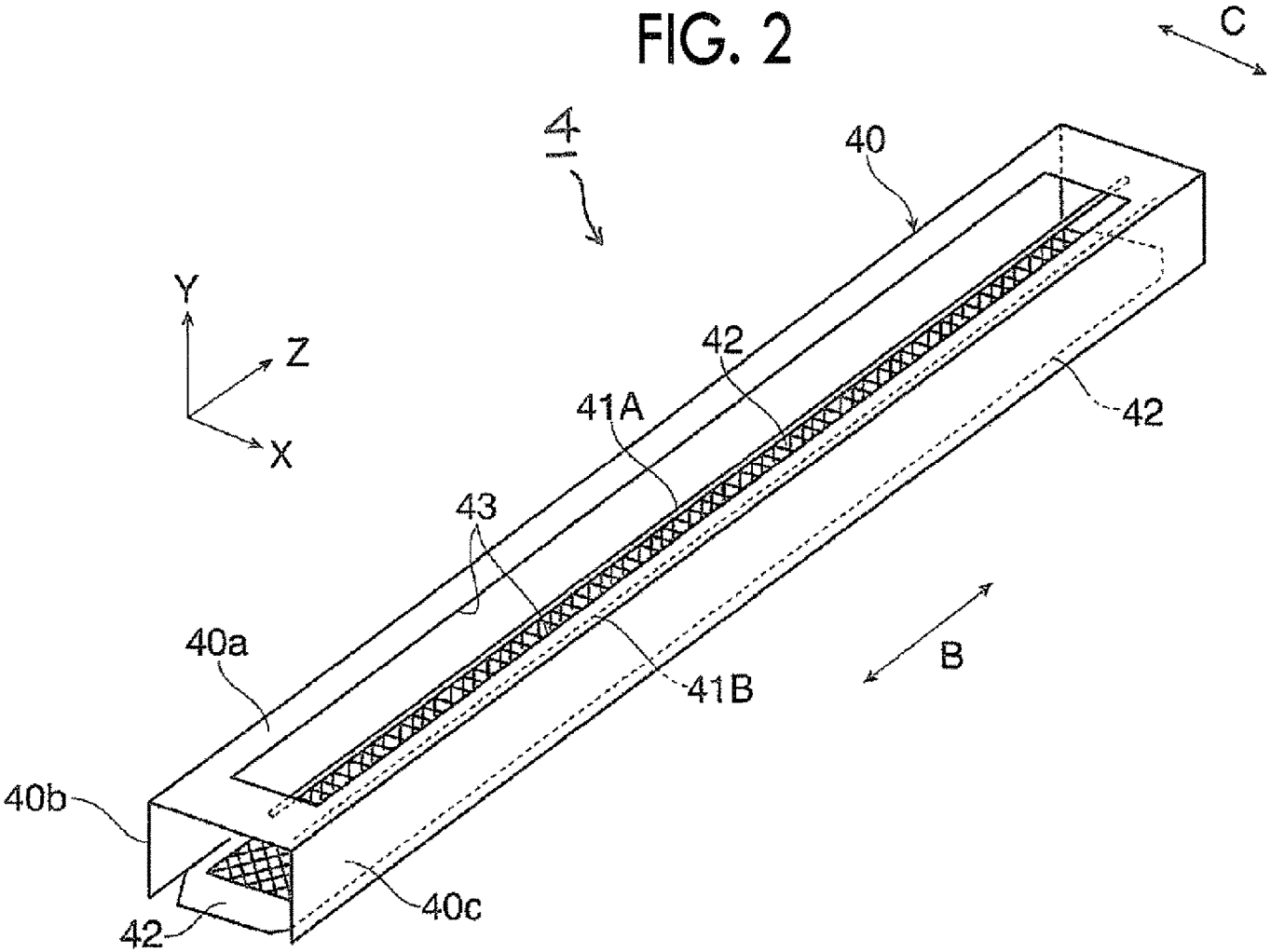
FIG. 2 is a schematic perspective view showing a charging device including a corona discharger provided in the image forming apparatus of FIG. 1.
Figure 3:
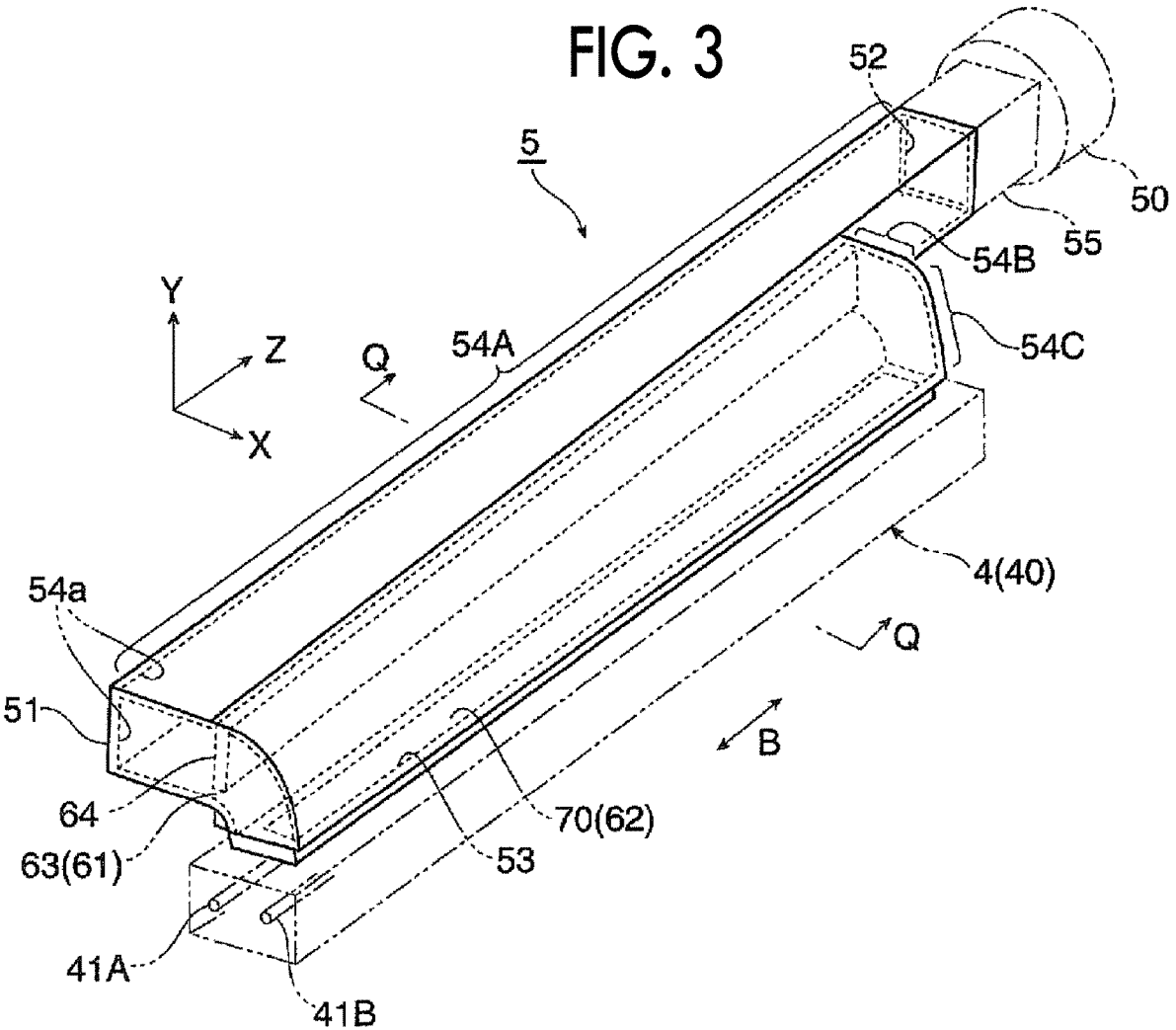
FIG. 3 is a schematic perspective view showing the outline of a blowing device (blower duct) to be applied to the charging device of FIG. 2.

FIGS. 1 to 3 show a blower duct and a blowing device and an image forming apparatus using the same related to the exemplary embodiment 1. FIG. 1 shows the outline of the image forming apparatus, FIG. 2 shows a charging device as a long target structure that is used for the image forming apparatus, and blasts air by the blower duct or blowing device, and FIG. 3 shows the outline of the blower duct or blowing device.

In the image forming apparatus 1, as shown in FIG. 1, an image forming unit 20 that forms a toner image constituted by toner as developer to transfer the toner to a sheet 9 as an example of recording material, a sheet feeder 30 that accommodates and transports sheets 9 to be supplied to the image forming unit 20, and a fixing device 35 that fixes the toner image formed by the image forming unit 20 on a sheet 9 are installed in an internal space of a housing 10 constituted by a support frame, a sheathing cover, or the like. Although only one image forming unit 20 is illustrated in the exemplary embodiment 1, the image forming unit may be constituted by plural image forming units.

The above image forming unit 20 is constructed, for example utilizing a well-known electrophotographic system, and is mainly constituted by a photoreceptor drum 21 that is rotation driven in the direction (the clockwise direction in the drawing) indicated by an arrow A, a charging device 4 that charges a peripheral surface that becomes an image formation region of the photoreceptor drum 21 with a required potential, an exposure device 23 that forms an electrostatic latent image with a potential difference that irradiates the surface of the photoreceptor drum 21 after charging with light (dotted line with an arrow) based on image information (signal) input from the outside, a developing device 24 that develops the electrostatic latent image as a toner image with a toner, a transfer device 25 that transfers the toner image to a sheet 9, and a cleaning device 26 that removes the toner or the like that remains on the surface of the photoreceptor drum 21 after transfer.

Among these, a corona discharger is used as the charging device 4. As shown in FIG. 2 or the like, the charging device 4 including the corona discharger is constituted by a so-called scorotron type corona discharger including a shielding case (surrounding frame member) 40 with an external shape having an oblong top plate 40*a*, and lateral plates 40*b* and 40*c* that hang downward from a long side portion extending along the longitudinal direction B of the top plate 40*a*, two end supports (not shown) that are respectively attached to both ends (short side portions) of the shielding case 40 in the longitudinal direction B, two corona discharge wires 41A and 41B that are attached in a state where the wires pass through the internal space of the shielding case 40 and are stretched almost in the shape of a straight line between these two end supports, and a grid-like grid electrode (electric field adjustment plate) 42 that is attached to a lower opening (discharge opening) of the shielding case 40 in a state where the plate covers the lower opening and is present between the corona discharge wires 41 and the peripheral surface of the photoreceptor drum 21. Reference numeral 40*d* shown in FIG. 4 or the like represents a partition wall that partitions the space where the two corona discharge wires 41A and 41B are arranged.

Additionally, the charging device 4 is arranged such that the two corona discharge wires 41A and 41B are present at least in an image forming target region along the direction of a rotational axis of the photoreceptor drum 21 in a state where the wires face each other at a predetermined interval (for example, a discharge gap) from the peripheral surface of the photoreceptor drum 21. Additionally, the charging device 4 is adapted such that charging voltages are respectively applied to the discharge wires 41A and 41B (between the wires and the photoreceptor drum 21) from a power unit (not shown) when an image is formed.

Moreover, with the use of the charging device 4, substances (undesired substances), such as debris of a sheet 9, a discharge product generated by corona discharge, and external additives adhere to the corona discharge wires 41 or the grid electrode 42, and are contaminated, and the corona discharge is no longer sufficiently or uniformly performed. As a result, poor charging, such as uneven charging, may occur. For this reason, in order to prevent or keep unnecessary substances from adhering to the discharge wires 41 and the grid electrode 42, a blowing device 5 for blasting air against the discharge wires 41 and the grid electrode 42 is provided together at the charging device 4. Additionally, the top face 40*a* of the shielding case 40 of the charging device 4 is formed with an inflow opening 43 for allowing the air from the blowing device 5 to flow thereinto. The inflow opening 43 is formed so that the opening shape thereof becomes oblong. In addition, the blowing device 5 will be described below in detail.

The sheet feeder 30 includes a sheet accommodation member 31 of a tray type, a cassette type, or the like that accommodates plural sheets 9 including a required size, required kind, or the like to be used for formation of an image, in a stacked state, and a delivery device 32 that delivers the sheets 9 accommodated in the paper accommodation member 31 one by one toward a transporting path. If the timing for sheet feeding comes, the sheets 9 are delivered one by one. Plural sheet accommodation bodies 31 are provided according to utilization modes. A one-dot chain line with an arrow in FIG. 1 shows a transporting path which a sheet 9 is mainly transported along and passes through. This transporting path for sheets is constituted by plural sheet transport roll pairs 33*a* and 33*b*, a transport guide members (not shown), or the like.

The fixing device 35 includes, inside a housing 36 formed with an introduction port and a discharge port through which a sheet 9 passes, a roller-shaped or belt-shaped heating rotary member 37 of which the surface temperature is heated to and maintained at required temperature by a heating means, and a roller-shaped or belt-shaped pressing rotary member 38 that is rotationally driven in contact with the heating rotary member at a required pressure so as to extend substantially along the direction of the rotational axis of the heating rotary member 37. The fixing device 35 allows a sheet 9 after a toner image is transferred to be introduced into and pass through a contact portion (fixing treatment section) that is formed as the heating roller member 37 and the pressing roller member 38 come into contact with each other.

Image formation by the image forming apparatus 1 is performed as follows. Here, a fundamental image forming operation when an image is formed on one side of a sheet 9 will be described as an example.

In the image forming apparatus 1, if the control device or the like receives a start command for an image forming operation, in the image forming unit 20, the peripheral surface of the photoreceptor drum 21 that starts to rotate is charged with predetermined polarity and potential by the charging device 4. At this time, in the charging device 4, corona discharge is generated in a state where charging voltages are applied to the two corona discharge wires 41A and 41B, respectively, and an electric field is formed between each of the discharge wires 41A and 41B and the peripheral surface of the photoreceptor drum 21, and thereby, the peripheral surface of the photoreceptor drum 21 is charged with required potential. In this case, the charging potential of the photoreceptor drum 21 is adjusted by the grid electrode 42.

Subsequently, an electrostatic latent image, which is constructed with a required potential difference as exposure is performed on the basis of image information from the exposure device 23, is formed on the peripheral surface of the charged photoreceptor drum 21. Thereafter, when the electrostatic latent image formed on the photoreceptor drum 21 passes through the developing device 24, the electrostatic latent image is developed with toner that is supplied from the developing roller 24*a* and is charged with required polarity, and is visualized as a toner image.

Next, if the toner image formed on the photoreceptor drum 21 is transported to a transfer position that faces the transfer device 25 by the rotation of the photoreceptor drum 21, the toner image is transferred by the transfer device 25 to a sheet 9 to be supplied through a transporting path from the sheet feeder 30 according to this timing. The peripheral surface of each photoreceptor drum 21 after this transfer is cleaned by the cleaning device 26.

Subsequently, the sheet 9 to which the toner image is transferred in the image forming unit 2 is transported so as to be introduced into the fixing device 35 after being peeled off from the photoreceptor drum 21, is heated under pressure when passing through the contact portion between the heating roller member 37 and the pressing roller member 38 in the fixing device 35, and is fixed on the sheet 9. The sheet 9 after this fixing is completed is ejected from the fixing device 35, and is transported and accommodated in an ejected paper accommodation section (not shown) formed, for example outside the housing 10.

A monochrome image constituted by a single-color toner is formed on one side of one sheet 9, and the fundamental image forming operation is completed. When there is an instruction for the image forming operation for plural sheets, a series of operations as described above are similarly repeated by the number of sheets.

Next, the blowing device 5 will be described.

As shown in FIGS. 1, 3, or the like, the blowing device 5 includes a blower 50 that has a rotary fan that sends air, and a blower duct 51 that takes in the air sent from the blower 50 and guides and blows out the air up to the charging device 4 that is an object to be blown.

As the blower 50, for example, an axial flow type blower fan is used and the driving thereof is controlled so as to send a required volume of air. Additionally, as shown in FIGS. 3 to 6, the blower duct 51 is formed in a shape having an inlet 52 that takes in the air sent from the blower 50, an outlet 53 that is arranged in a state where the outlet faces the portion (the top face 40*a* of the shielding case 40 or its inflow opening 43), in the longitudinal direction B, of the long charging device 4 against which the air taken in from the inlet 52 is blown, and sends the air so as to flow along a direction orthogonal to the longitudinal direction B, and a passage part 54 formed with a passage space 54*a* for connecting between the inlet 52 and outlet 53 to pass air.

The passage part 54 of the blower duct 51 has one end portion provided with the inlet 52 and opened and the other end portion closed, and the overall passage part is constituted by an angular-tube-shaped introduction passage part 54A formed so as to extend along the longitudinal direction B of the charging device 4, an angular-tube-shaped first bending passage portion 54B formed so as to extend after being almost at a right angle to a substantially horizontal direction (direction substantially parallel to the coordinate axis X) in a state where the width of the passage space is increased from a part near the other end portion of the introduction passage part 54A, and a second bending passage portions 54C formed so as to extend after being finally bent in a downwardly perpendicular direction (direction substantially parallel to the coordinate axis Y) so as to approach the charging device 4 in a state where the width of the passage space remains equal from one end portion of the first bending passage portion 54B. A termination end of the second bending passage portion or bending part 54C is formed with an outlet 53 including an opening shape that is slightly narrower than the cross-sectional shape of the passage space of the termination end (however, the longitudinal length of the oblong shape is almost the same). The width (dimension along the longitudinal direction B) of both the passage spaces 54*a* of the first bending passage portion 54B and the second bending passage portion 54C is set to almost the same dimension.

The inlet 52 of the blower duct 51 is formed so that the opening shape thereof becomes substantially square. A connection duct 55 for connecting between the blower duct and the blower 50 to send the air from the blower 50 up to the inlet 52 of the blower duct 51 is attached to the inlet 52 (FIG. 3). Additionally, the outlet 53 of the blower duct 51 is formed so that the opening shape thereof becomes a long shape (for example, oblong shape) parallel to the portion of the charging device 4 in the longitudinal direction B. For this reason, the blower duct 51 has the relationship that the inlet 52 and the outlet 53 are formed in mutually different opening shapes. In addition, even in a case where the inlet 52 and the outlet 53 have the same shape, when the inlet and the outlet are formed so as to have mutually different opening areas (when the inlet and outlet have a similar shape) is included in the relationship where the inlet and the outlet are formed in mutually different opening shapes.

Here, in the blower duct 51 in which the inlet 52 and the outlet 53 are formed in mutually different opening shapes in this way, the portion in which the cross-sectional shape of the passage space 54*a* is changed on the way is present the passage part 54 that connects between the inlet 52 and outlet 53. Incidentally, in the blower duct 51, the cross-sectional shape of the passage space 54*a* including a substantially square shape, of the introduction passage part 54A is changed to the cross-sectional shape of the passage space 54*a* including an oblong shape that spreads only in the horizontal direction (irrespective of height) in the first bending passage portion 54B. In other words, the cross-sectional shape of the passage space 54*a* of the introduction passage part 54A is the cross-sectional shape of the passage space 54*a* that abruptly becomes wide in the first bending passage portion 545.

Additionally, in the case of the blower duct 51 in which such a portion in which the cross-sectional shape of the passage space 54*a* changes is present, disturbance, such as flaking or swirling, occurs in the flow of air in the portion in which the cross-sectional shape of the blower duct changes. For this reason, even if air with a uniform wind speed is taken in from the inlet 52, the wind speed of the air that comes out from the outlet 53 tends to become non-uniform. In addition, the tendency for the wind speed of the air that comes out from the outlet in this way to occur substantially similarly even in a case where the direction in which the air in the blower duct 51 is caused to flow (advanced) changes irrespective of the presence of a change in the cross-sectional shape of the passage space 54*a*.

Figure 15A:
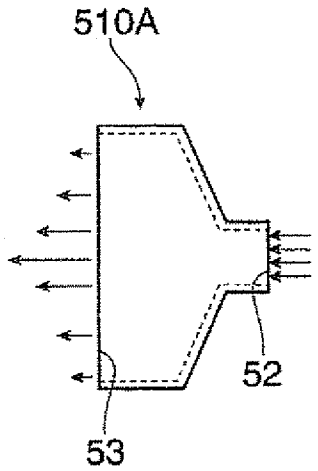
FIGS. 15A to 15D are cross-sectional views showing still another configuration example of the blower duct.
Figure 15B:
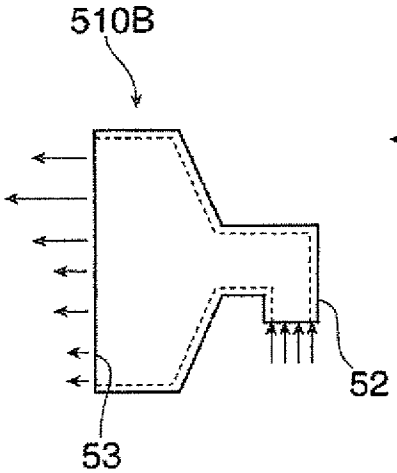
Figure 15C:
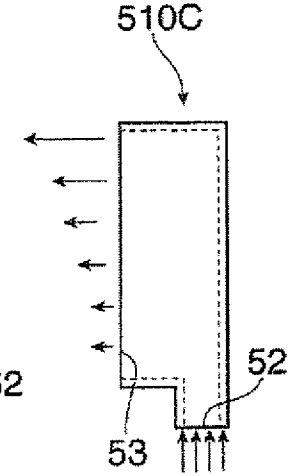
Figure 15D:
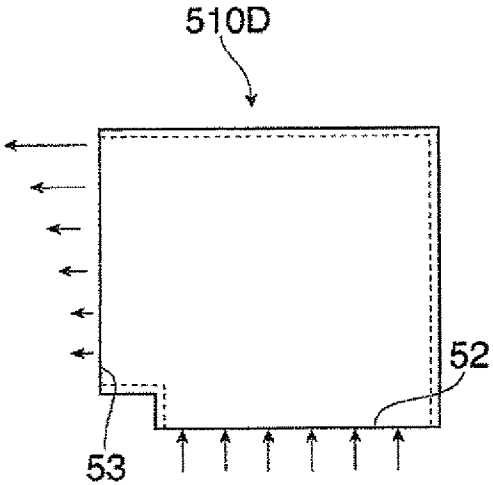

FIGS. 15A to 15C show representative examples 510A to 510C of the blower duct in which the inlet 52 and the outlet 53 are formed in mutually different opening shapes. In the drawings, respective states of the wind speed of air taken into the inlet 52 and the wind speed of air that comes out from the outlet 53 in the respective ducts 510 are shown by the lengths of arrows, respectively. FIGS. 15A to 15D show the respective blower ducts 510 seen from the top face thereof. Additionally, in the drawings, cases where the lengths of the arrows are the same show that the wind speeds are the same, and cases where the lengths of the arrows are different show that the wind speeds are different. Moreover, dotted lines in the drawings show (side wall portions that form) the passage spaces of the respective ducts. Incidentally, the blower ducts 510B and 510C are also configuration examples in which the direction in which air is caused to flow is changed on the way, and at least one of the cross-sectional shape and cross-sectional area of a passage space is changed. In addition, the blower duct 510D shown in FIG. 15D is a configuration example in which the inlet 52 and the outlet 53 are formed in the same opening shape (and the same opening area), and is a duct in that only a direction in which air is caused to flow is changed on the way.

Therefore, as shown in FIGS. 3 to 6, or the like, two suppressing parts 61 and 62, or first and second suppressing members, respectively, that suppress the flow of air are provided in different parts in the direction (the direction of the arrow represented by the symbol E) that the air of the passage space 54*a* of the passage part 54 is caused to flow, in the blower duct 51 of the blowing device 5. The suppressing part 62 of the two suppressing parts is an outlet (lowest downstream) suppressing part provided at the outlet 53 that becomes a terminal of the passage part 54, and the other suppressing part 61 is a first upstream suppressing part provided at a part located at the beginning closer to the upstream side in the direction in which air is caused to flow than the outlet stream suppressing part 62 in the passage space 54*a* of the passage part 54.

The first upstream suppressing part 61 is provided almost at an almost intermediate position in the direction in which air is caused to flow in the passage space 54*b* of the first bending passage portion 54B. The first upstream suppressing part 61 is constructed in such a manner to interrupt a portion of the passage space 54*b* in a state where the portion of the passage space runs along the direction parallel to the longitudinal direction (the same direction as the longitudinal direction B of the charging device 4) of the opening shape of the outlet 53, and so as to have a gap 63 in a shape that extends in the longitudinal direction of the opening shape of the outlet 53.

The first upstream suppressing part 61 in the exemplary embodiment 1 is constructed by causing a plate-shaped partition member 64 to be present within the passage space 54*b* of the bending passage portion 54B without changing the appearance of the first bending passage portion 54B. Specifically, the partition member 64 closes an upper space portion in the passage space 54*b* of the first bending passage portion 54B, and is arranged so that a lower end 64*a* of the partition member has a required interval (height) H with respect to the bottom (inner wall) 55*a* of the passage space 54*b*. This forms a structure where the gap 63 is present in a lower part of the passage space 54*b*. The partition member 64 is formed by molding integrally with the same material as the duct 51 or is formed from a material separate from the duct 51.

The height H, path length M, and width (longitudinal length) W of the gap 63 are selected and set from the viewpoint of making the wind speed of air that has flowed into the first bending passage portion 54B from the introduction passage part 54A as uniform as possible, and are set in consideration of the dimension (capacity) of the duct 51, the flow ratio per unit time of air caused to flow to the duct 51, the charging device 4, or the like. For example, the height H of the gap 63 may be set to the dimension uniformly or partially changed from the above viewpoint or the like without being limited to a case where the dimension is the same in the longitudinal direction of the width W.

On the other hand, the outlet suppressing part 62 is formed by bringing about a state where the passage space (opening) in the termination end (outlet 53) of the second bending passage portion 54C is closed by a permeable member 70 having plural ventilation portions 71. Additionally, the permeable member 70 that constitutes the outlet suppressing part 62, as will be described in detail is divided into a ventilation adjustment region or first area 70*a* where the permeability that is a degree at which air passes is reduced and adjusted, and a ventilation non-adjustment region or second area 70*b* where the permeability is not particularly reduced.

Figure 6:
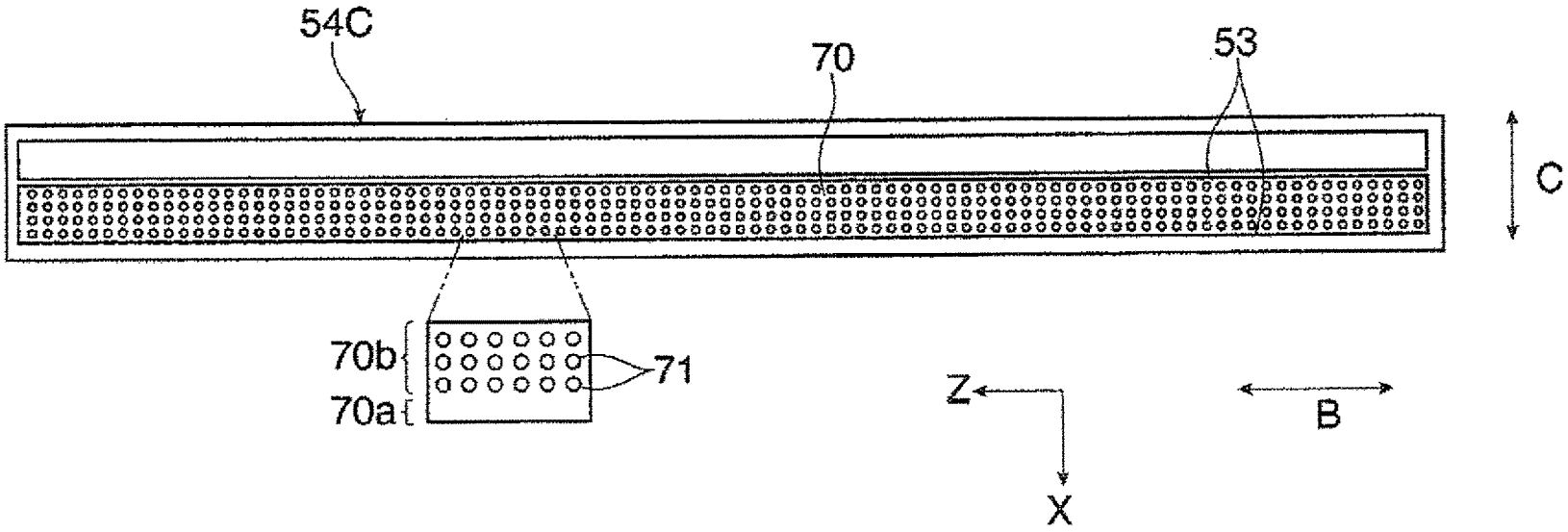
FIG. 6 is a view showing a state when the blowing device of FIG. 3 is seen from below (outlet)
Figure 7A:
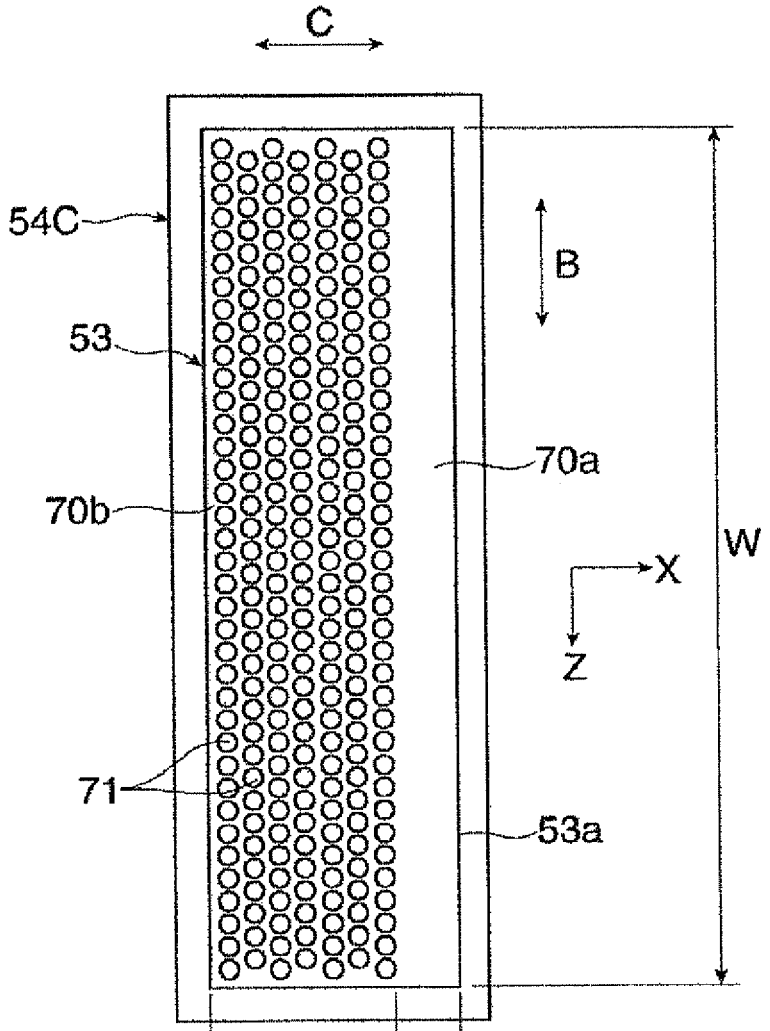
FIGS. 7A and 7B are a plan view and a cross-sectional view showing the configuration of an end region or the like of a permeable member that constitutes an outlet suppressing part in the blower duct of FIG. 4.
Figure 7B:
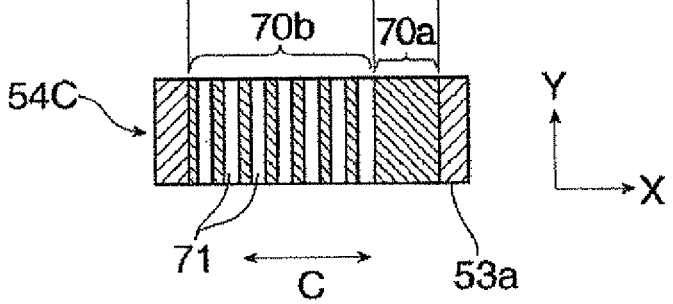

All the plural ventilation portions 71 in the ventilation non-adjustment region 70*b* (the ventilation adjustment region 70*a* may be included) are through holes that extends so that each opening shape is substantially circular and passes through in the shape of a straight line, as schematically shown in FIG. 6 or FIGS. 7A and 7B. Additionally, the plural ventilation portions 71 are arranged, for example, at equal intervals along the longitudinal direction (B) of the opening shape of the outlet 53, and are arranged so as to be present with plural (for example, four or more) rows at the same intervals as the above regular intervals even in the lateral direction C orthogonal to the longitudinal direction. Thereby, the plural ventilation portions 71 in the ventilation non-adjustment region 70*b* or the like are formed so as to be dotted throughout the ventilation non-coordination area 70*b* or the like. For this reason, the permeable member 70 in the exemplary embodiment 1 is a perforated plate formed so that the plural ventilation portions (through holes) 71 are dotted in a plate-shaped member in the ventilation non-adjustment region 70*b*. Moreover, it is preferable that the plural ventilation portions 71 be formed so as to be dotted almost uniformly (at an almost uniform density) in a required region (corresponding to the ventilation non-adjustment region 70*b*) in the opening region of the outlet 53. However, unless the air that comes out from the outlet 53 comes out non-uniformly, the ventilation portions may be formed so as to be present in a slightly dense state.

Additionally, the blower duct 51 of the blowing device 5 is influenced by, for example, the presence of the first suppressing part 61 of the blower duct 51, the presence of the second bending passage portion 54C, or the like. Thereby, even when there is the strength of flow in the air that has reached the passage space 54*c* before the outlet 53 of the blower duct 51, the air that comes out from the outlet 53 comes out in a state where the unevenness of wind speed is reduced in both directions of the longitudinal direction B of the outlet 53, and the lateral direction C orthogonal to the longitudinal direction. Therefore, as shown in FIGS. 4, 6, 7A, 7B, or the like, the permeability of the end region 70*a* present at one end in the lateral direction C orthogonal to the longitudinal direction B in the region along the longitudinal direction B of the opening shape of the outlet 53 in the permeable member 70 of the outlet suppressing part 62 is set to a value smaller than the permeability of a region 70*b* other than the end region 70*a*.

That is, only by providing the blower duct 51 with the above-mentioned two suppressing parts 61 and 62 (refer to FIG. 16A), as will be described below, for example, in a case where the air volume of the air introduced from the inlet 52 is made relatively small, the air that comes out from the outlet 53 of the blower duct 51 tends to come out in a state where the wind speeds become significantly different in both directions (especially the lateral direction) of the longitudinal direction B of the outlet 53 and the lateral direction C (refer to FIG. 10A). In the blower duct 51 illustrated in FIG. 16A, the tendency for the wind speed at the post-position that is one end in the lateral direction to become significantly faster than and different from the wind speed at the pre-position that is the other end in the lateral direction is strong.

For this reason, the end region 70*a* present at one end of the permeable member 70 of the outlet suppressing part 62 in the lateral direction C becomes a means for reducing the unevenness in the wind speed of the air that comes out from that outlet 53 in both the directions. In addition, the above end region 70*a* present at one end in the lateral direction C will also be referred to as the "ventilation adjustment region" as mentioned above, and the other region 70*b* will also be referred to as the "ventilation the non-adjustment region" as mentioned above.

As for the one end of the outlet 53 in the lateral direction C that specifies the end region (ventilation adjustment region) 70*a*, one end on the side where the wind speed of the air that comes out from the outlet 53 is relatively fast (flow is strong) is selected.

Figure 4:
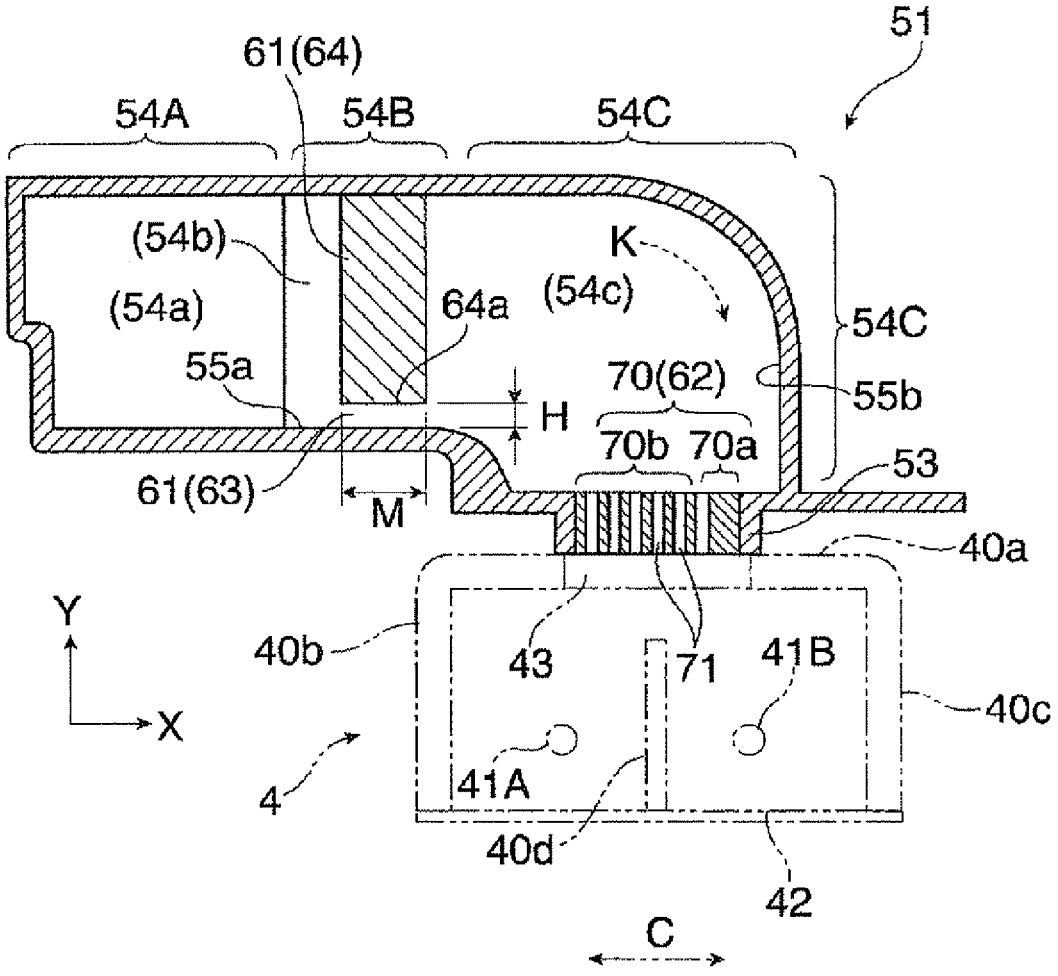
FIG. 4 is a cross-sectional view along the line Q-Q of the blowing device (blower duct) of FIG. 3.

In the end region (ventilation adjustment region) 70*a* in the exemplary embodiment 1, the outlet suppressing part 62 is provided at the outlet 53 at the terminal of the second bending passage portion 54C of the blower duct 51. Therefore, one end of the outlet 53 in the lateral direction C that specifies the end region 70*a* becomes one end on the side present at a termination position outside (inner wall portion 55*b*) of the second bending passage portion 54C in the bending direction K as shown in FIG. 4. In practice, in a case where the end region 70*a* in which the permeability is reduced is not formed in the permeable member 70 of the outlet suppressing part 62 (in a case where the adjustment that reduces permeability is not performed on the permeable member 70 of the entire region of the outlet 53), the wind speed in an outlet region (region that becomes the post-position as described below) present at the termination position outside the second bending passage portion 54C in the bending direction. K becomes relatively faster than the wind speed of the other region (region that becomes the pre-position as described above) (refer to FIG. 10A).

Additionally, it is preferable that the end region 70*a* be provided in a region with a ratio of from 5% to 20% with respect to the entire region of the outlet 53 in the lateral direction C. That is, as shown in FIGS. 7A and 7B, it is preferable that the length La of the end region 70*a* in the lateral direction C be within a range of 5 to 20% when being expressed by the ratio (percentage=(La/L)×100) to the total length L in the lateral direction C. If the ratio of the end region 70*a* in the lateral direction C is less than 5%, the air that comes out at a stronger wind speed from the end that corresponds to the end region 70*a* of the outlet 53 cannot be sufficiently suppressed and adjusted. On the contrary, if the ratio exceeds 20%, the air that comes out at a stronger wind speed from the end corresponding to the end region 70*a* is excessively suppressed, and the wind speed of the end region may be a wind speed that is relatively slower than the wind speed of the air that comes out from a region (for example, a region that becomes the pre-position as described below) corresponding to the other region (ventilation adjustment region) 70*b*. The symbol W in FIGS. 7A and 7B represents the above length along the longitudinal direction B of the outlet 53.

The end region 70*a* in the exemplary embodiment 1 has a form in which the portion of the permeable member 70 corresponding to the region 70*a* is not provided with the ventilation portions (through holes) 71 (in other words, a form in which the ventilation portions 71 are closed). Thereby, the permeability in the end region 70*a* is made lower than the permeability of the other region (ventilation non-adjustment region) 70*b*.

The ratio in which the permeability in the end region 70*a* is reduced is set according to the strength of the flow of air that arrives at the passage space 54*c* present before the outlet suppressing part 62 of the ventilation duct 50, for example, but is for example a ratio in which the value of 50% to 100% of the permeability in the other region 70*b* is reduced. The ratio in which the value of 100% is reduced corresponds to a case where the permeability of the other region 70*b* is set to zero. This corresponds to an aspect that the permeability of the end region 70*a* in the present embodiment is reduced.

Here, the permeability becomes the occupancy of the opening area (value when all the opening areas of respective holes are totaled) of all the through holes 71 to the total area of the surface of a perforated plate, for example in a case where the permeable member 70 is a perforated plate formed with the plural through holes 71 described earlier. That is, the permeability D that in this case is expressed by the following equation "(Opening area of all through holes/Total area of plate member)×100". Additionally, the permeability in a case where the permeable member 70 is a member other than this will be described below.

The permeable member 70 is formed by integrally molding from the same material as the duct 51 or is formed from a material separate from the duct 51 and mounted on the outlet 53. The opening shape, opening dimension, hole length, and hole presence density of the ventilation portions (holes) 71 in the ventilation non-adjustment portion 70*b* are selected and set from a viewpoint of making the wind speed of air that has flowed out of the second bending passage portion 54C through the outlet 53 as uniform as possible, and are set in consideration of the dimension (capacity) of the duct 51, the flow rate per unit time of air caused to flow to the duct 51, the charging device 4, or the like.

In addition, in a case where the ventilation adjustment portion 70*a* is provided, ventilation holes (73, 75) that are constituents that reduce the permeability (refer to FIGS. 12A and 125 or FIGS. 13A and 135), the opening shape, opening dimension, hole length, and hole presence density of the ventilation portions (holes) 73 and 75 are also selected and set particularly from a viewpoint of making the wind speed of air that has flowed out of the second bending passage portion 54C through the outlet 53 as uniform as possible. Additionally, in a case where no ventilation holes 73 and 75 are provided in the ventilation adjustment portion 70*a* (FIGS. 7A and 7B or the like), the region 70*a* that becomes the ventilation adjustment region may be formed from a material separate from the other region (ventilation non-adjustment region) 70*b*.

The operation of the blowing device 5 will be described below.

If the blowing device 5 arrives at driving setting timing such as image forming operation timing or the like, the blower 50 is first rotationally driven to send out a required volume of air. The air (E) sent from the started blower 50 is taken into the passage space 54*a* of the passage part 54 through the connection duct 55 from the inlet 52 of the blower duct 51.

Figure 5:
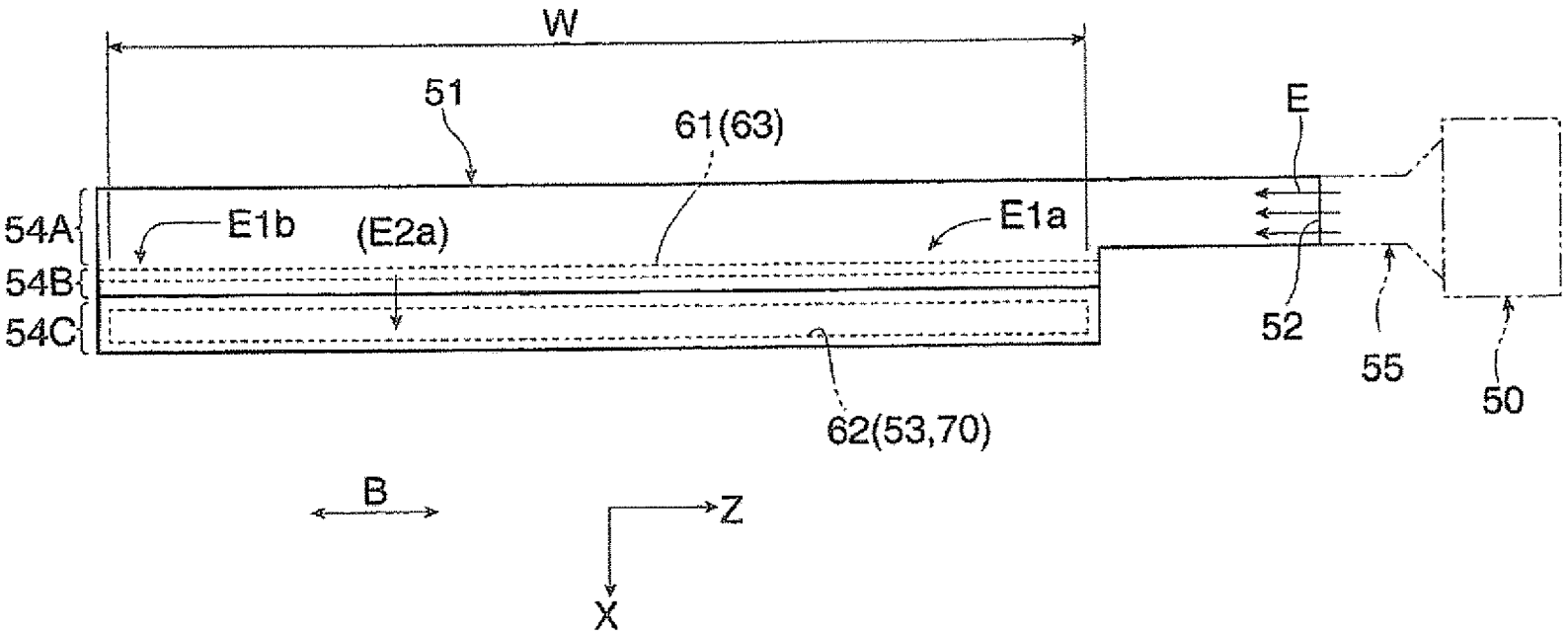
FIG. 5 is a schematic view showing a state when the blowing device of FIG. 3 is seen from above.
Figure 8:
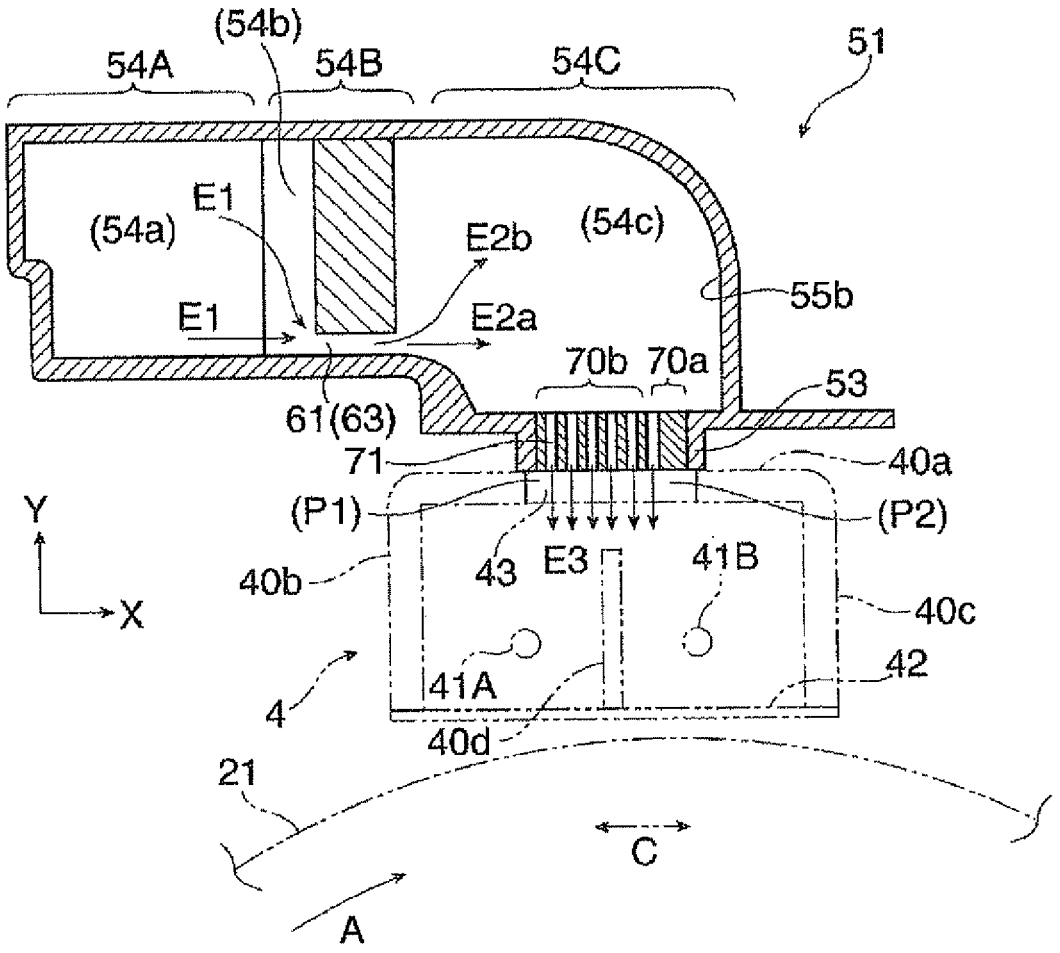
FIG. 8 is an explanatory view showing the operating state or the like of the blowing device of FIG. 3.

Subsequently, as shown in FIG. 5 or 8, the air (E) taken into the blower duct 51 is sent so as to flow into the passage space 54*b* of the first bending passage portion 54B through the passage space 54*a* of the introduction passage part 54A (refer to arrows E1*a*, E1*b*, or the like of FIG. 5). The air (E1) sent into the first bending passage portion 54B passes through the gap 63 of the first upstream suppressing part 61, and proceeds in a state where the traveling direction (direction in which air flows) thereof is changed to an almost orthogonal direction.

In this case, the air (E2) when passing through the gap 63 of the first upstream suppressing part 61 has its flow suppressed by the gap 63 of the first upstream suppressing part 61 (the pressure of the air is brought into a raised state), and tends to flow out of the gap 63 in a uniform state. Moreover, as for the air (E2) when flowing into the passage space 54*c* of the first bending passage portion 54B, the direction of the air when flowing out of the gap 63 of the suppressing part 61 is aligned substantially in a direction orthogonal to the longitudinal direction (B) of the outlet 53.

Subsequently, the air (E2) that has flowed into the passage space 54*c* of the second bending passage portion 54C, as indicated by an arrow E3, flows into the passage space 54*c* of the second bending passage portion 54C whose volume is larger than the passage space 54*a* of the introduction passage part 54A or the space of the gap 63, and is thereby swirled and stagnated within the passage space 54*c* of the second bending passage portion 54C, and the unevenness of the wind speed is reduced.

At this time, a portion E2*a* of the air (E2) that has passed through the gap 63 of the first upstream suppressing part 61 and has flowed into the passage space 54*c* proceeds almost linearly almost the path of a gap 63. Additionally, the other air E2*b* proceeds in such a curved manner that the air is diffused within the passage space 54*a* of the second bending passage portion 54C. Particularly in a case where the air volume introduced from the inlet 52 of the blower duct 51 is relatively large, the flow of the air E2*a* that proceeds linearly from the gap 63 becomes stronger than that of the other air E2*b*.

Finally, the air (E2) that has flowed into and stagnated in the passage space 54*c* of the second bending passage portion 54C, as shown in FIG. 8, passes through the plural ventilation portions (holes) 71 in the region 70*b* that becomes the ventilation non-adjustment portion of the permeable member 70 that constitutes the outlet suppressing part 62 provided at the outlet 53 that is a termination end of the bending passage portion 54C, and is thereby blown out from the outlet 53 in a state where the traveling direction thereof is changed (refer to the direction, length, or the like of the arrow E3).

In this case, the air (E3) blown out from the outlet 53 passes through the plural ventilation portions 71 in the region 70*b* of the permeable member 70 that is relatively narrower than the opening area of the outlet 53, and is thereby sent out in a state where the flow thereof is suppressed (at this time, the pressure of the air is brought into a raised state).

On the other hand, the air (E2*a*) that proceeds linearly and flows into the passage space 54*c* of the second bending passage portion 54C tends to collide with the inner wall portion 55*b* present outside of the bending passage portion 540 in the bending direction K, and a portion thereof tends to flow out towards one end 53*a* of the outlet 53 near the termination end of the inner wall portion 55*b*. For this reason, in a case where the outlet suppressing part 62 is constructed using the permeable member 70 simply formed by dotting the ventilation holes 71 in a region corresponding to the entire region of the outlet 53 so as to have a permeability (FIG. 19A), the wind speed of the air that comes out from the end region of the one end 53*a* of the outlet 53 near the termination end of the inner wall portion 55*b* becomes faster than the wind speed of the air that comes out from the other end region (refer to FIG. 10A).

However, the air Eta has its flow interrupted by the end region 70*a* where the permeability of the permeable member 70 that constitutes the outlet suppressing part 62 is reduced (brought into a zero state), and finally moves to the region 70*b* that is finally the other ventilation non-adjustment region.

Finally, the air (E3) that passes through the outlet suppressing part 62 and is blown out from the outlet 53 passes through the plural ventilation portions 71 that are almost uniformly dotted in the region 70*b* except for the end region 70*a* of the permeable member 70 present at the one end 53*a* of the outlet 53 and that are formed on the same conditions, and is thereby sent out from the outlet 53 in a uniform state. Moreover, the air (E3) blown out from the outlet 53 has its traveling direction changed to a direction facing the charging device 4 in the direction substantially orthogonal to the longitudinal direction B of the outlet 53, and is sent out.

From the above, all air (E3) that passes the outlet suppressing part 62 and comes out from the outlet 53 is sent out in a state where the traveling direction thereof becomes the direction substantially orthogonal to the longitudinal direction of the outlet 53, and the wind speed thereof is brought into a substantially uniform state. Additionally, the wind speed of the air (E4) that comes out from the outlet 53 is brought into a substantially uniform state in the longitudinal direction (B) of the opening shape (oblong shape) of the outlet 53, and is brought into a substantially uniform state also in the lateral direction C.

Additionally, the air (E3) sent out from the outlet 53 of the blower duct 51, as shown in FIG. 8, is blown into and flows into the case 40 through the inflow opening 43 formed in the top face 40*a* of the shielding case 40 of the charging device 4, and is blown against the grid electrode 42 so as to be present in the two corona discharge wires 41A and 41B arranged within a space divided with a partition wall 40*d* present at the center of the internal space of the case 40 as a boundary, and the lower opening of the case 40. At this time, since the air blown against the corona discharge wires 41A and 41B and the grid electrode 42 comes out from the outlet 53 at a substantially uniform wind speed in both the directions of the longitudinal direction B and the lateral direction C of the outlet 53 of the blower duct 51, the air is also blown against the two discharge wires 41A and 41B and grid electrode 42 in a substantially equal state.

Thereby, unnecessary substances, such as paper debris, an additive agent of toner, and a discharge product, that are going to adhere to the two discharge wires 41A and 41B and the grid electrode 42, respectively, may be kept away. As a result, degradation, such as unevenness may be prevented from occurring in discharge performance (charge performance) owing to sparse adhesion of unnecessary substances to the discharge wires 41A and 41B or the grid electrode 42 in the charging device 4, and the peripheral surface of the photoreceptor drum 21 may be more uniformly (uniformly in both directions of the axial direction and the circumferential direction along the rotational direction A) charged. Additionally, a toner image formed in the image forming unit 20 including the charging device 4, and an image finally formed on a sheet 9 are obtained as excellent images in which occurrence of image defects (uneven density or the like) resulting from charging defects, such as uneven charging, is reduced.

FIGS. 9A to 11 show the results of evaluation tests when the performance characteristics (wind speed distribution at the outlet 53 of the blower duct 51) of the blowing device 5 are investigated.

Figure 16A:
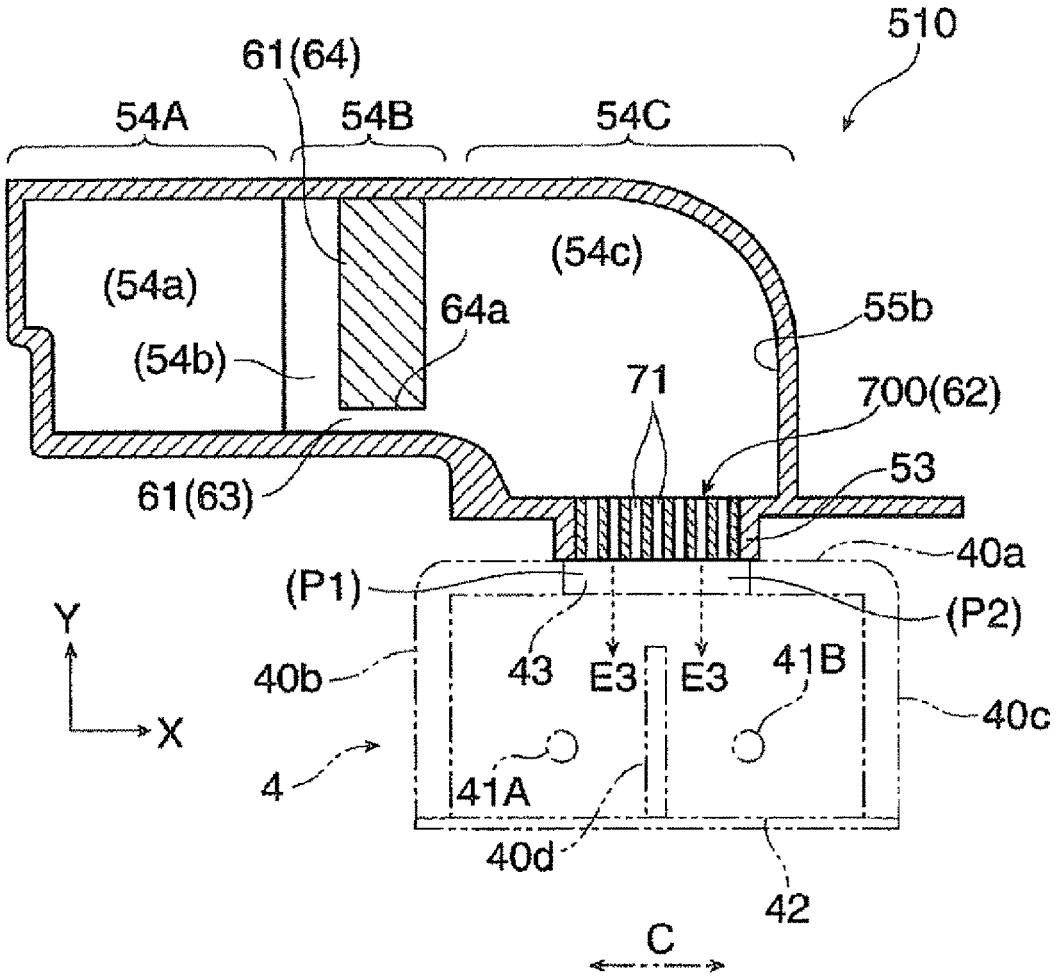
FIG. 16A is a cross-sectional view showing the configuration of a blower duct of a comparative standard example.
Figure 16B:
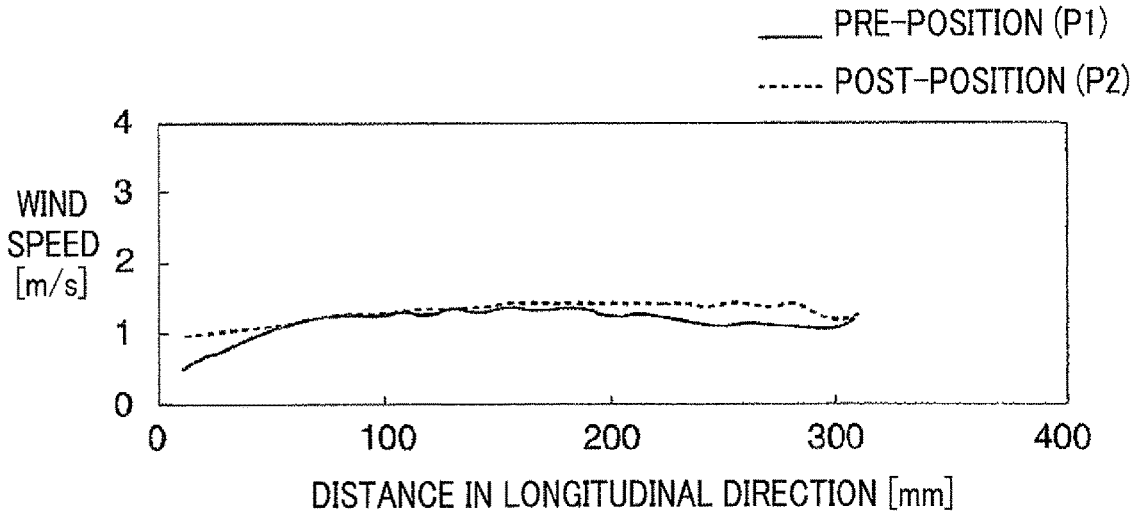
FIG. 16B is a graph showing the results of evaluation tests regarding the performance characteristics of a blowing device to which a blower duct is applied.
Figure 17A:
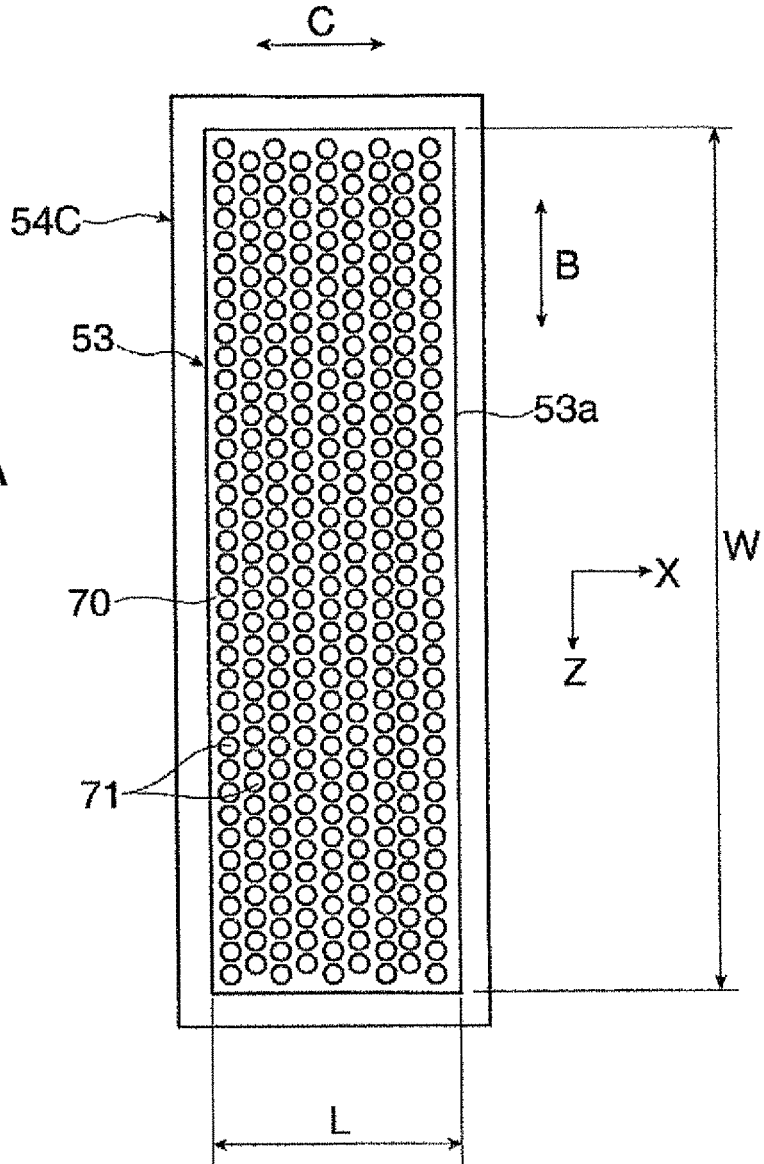
FIGS. 17A and 17B are a plan view and a cross-sectional view showing the configuration of a permeable member that constitutes an outlet suppressing part in the blower duct of FIGS. 16A and 16B.
Figure 17B:
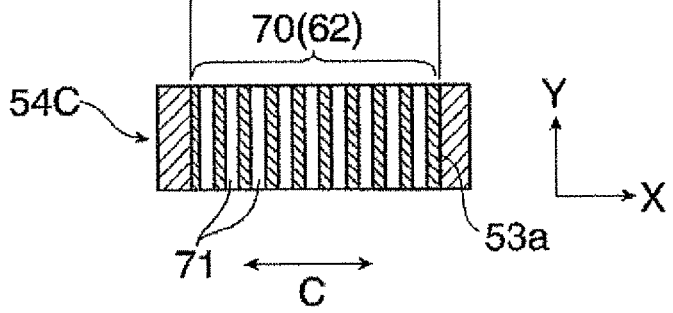

In the tests, the blower duct 510 shown in FIGS. 16A and 16B is used as a reference standard example. The blower duct 510 of this reference standard example, as shown in FIG. 17, is different from the blower duct 51 (FIG. 4, FIGS. 7A and 7B, or the like) in the exemplary embodiment 1 in that the plural ventilation holes 71 are formed in the entire region of the opening shape (oblong shape) of the outlet 53 as the permeable member 70 that constitutes the outlet suppressing part 62, and has the same components as those of the blower duct 510 in terms of the other configuration. As the permeable member 70 of this blower duct 510, porous member is used in which the ventilation holes 71 with a hole diameter of 1 mm and a length of 3 mm are formed such that rows obtained by linearly arranging 121 holes in the longitudinal direction B of the outlet 53 become 17 rows in the lateral direction C of the outlet 53, and the density of the holes becomes 40.2 holes/cm$^2$.

The tests include the blower duct 510 of the reference standard example, and are performed by preparing, as the blower duct 51 in the exemplary embodiment 1, plural blower ducts of a form in which the rows from first to fifth rows that are present at the one end 53*a* of the outlet 53 among the rows of the ventilation holes 71 in the lateral direction C of the outlet 53 are not formed in the permeable member 70 that constitutes the outlet suppressing part 62 while being increased one row by one row (in other words, a form in which the ventilation holes are closed while being increased one row at a time) and by using blowing devices 5 mounted with the respective blower ducts 510 and 51, respectively.

Regarding test contents, air with an average air volume of 0.25 m$^3$/min is introduced from the blower 50, and then, the wind speed (wind speed in the entire region of the outlet in the longitudinal direction B) of the air blown out from the outlet 53 of each of the blower ducts 51 and 510 is measured. The measurement of the wind speed is performed by using an air speedometer (UAS1200LP made by DEGREE CONTROLS, INC), and the moving the air speedometer in the longitudinal direction B at two places including the position of the discharge wire 41A that approximately corresponds to the end position P1 (pre-position) located on the upstream side in the outlet 53 in the rotational direction A of the photosensitive drum 21 as shown in FIG. 8, and the position of the discharge wire 41B approximately corresponding to the end position P2 (post-position) located on the downstream side in the rotational direction A.

As the blower ducts 51 and 510, there are used blower ducts in which the overall shapes are those as shown in FIG. 3 to FIGS. 7A and 7B or FIGS. 16A and 16B, the inlets 52 have a substantially square opening shape of 22 mm×23 mm, and the outlets 53 have an oblong opening shape of 350 mm (dimension in the longitudinal direction B)×17.5 mm (dimension in the lateral direction C). Additionally, the first upstream suppressing parts 61 are constructed by arranging a substantially flat-plate partition member 64 such that a gap 63 in which the height H is 1.5 mm in all parts along the longitudinal direction B of the outlet 53, the path length M is 8 mm, and the width W becomes 345 mm is present. Moreover, the outlet suppressing parts 62 are constructed by arranging the ventilation holes 71 with a hole diameter of 1 mm and a length of 3 mm such that the outlet 53 is closed by the porous member 70 provided on the conditions that the density of the holes becomes 40.2 holes/cm$^2$.

The end region (ventilation adjustment region) 70*a* present at the one end 53*a* of the outlet 53 of the permeable member 70 corresponds to a region where the rows (first row to fifth row) of the ventilation holes 71 that are present in order from the one end 53 of the outlet 53 among a larger number of ventilation holes 71 formed in the permeable member 70 in the blower duct 510 of the reference standard example. Incidentally, the respective end regions 70*a* in this case becomes regions with ratios of 5.9% (in a case where the first row is not formed: one row closed), 11.8% and 17.6% (in a case where the ventilation holes are not formed up to the third row), and 23.5% and 29.4% (when the ventilation holes are not formed up to the fifth row: five rows closed) with respect to the entire region L of the outlet 53 (=17.5 mm).

Figure 10A:
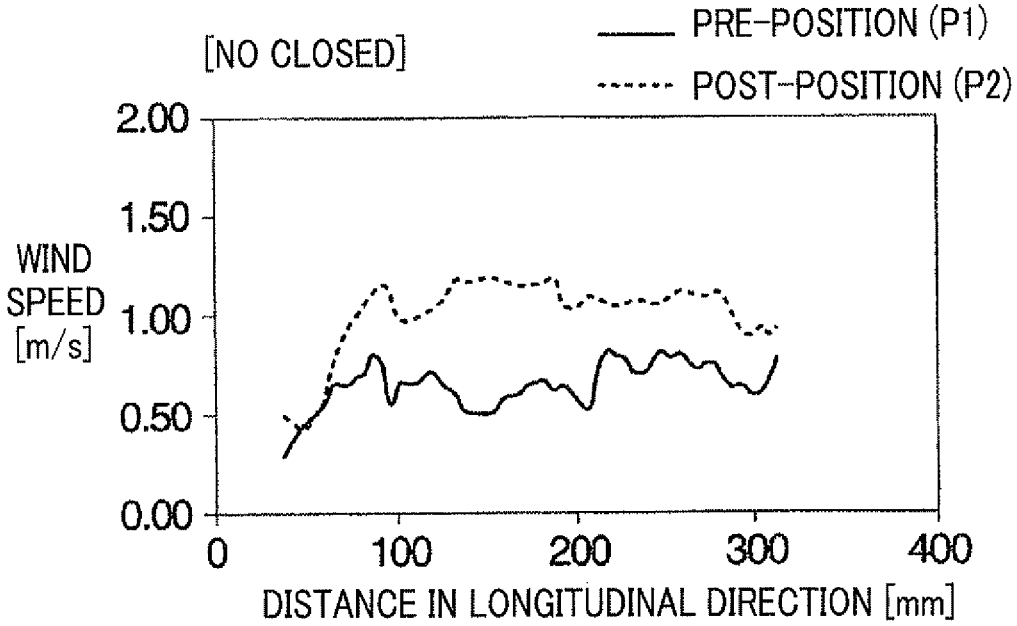
FIGS. 10A to 10C are graphs showing evaluation tests regarding the performance characteristics of various types of blower ducts.

First, in a case where the blower duct 510 (FIG. 16A) of the reference standard example in which the ventilation holes 71 in the permeable member 70 of the outlet suppressing part 62 are not closed, and the permeability is not adjusted is used, the measurement results become the results as shown in FIG. 10A. That is, the wind speed at the post-position P2 of the outlet 53 becomes faster than the wind speed at the pre-position P1 in almost the entire region in the longitudinal direction B of the outlet 53, and the wind speed in the lateral direction C of the outlet 53 is brought into a non-uniform state.

In addition, as for the blower ducts 510 of the reference standard example, in a case where the volume of air introduced from the inlet 52 is changed to, for example a reduced value of 0.17 m$^3$/min from, for example 0.25 m$^3$/min, the measurement results are as follows. That is, as shown in FIG. 16B, the wind speed at the post-position P2 and the wind speed at the pre-position P1 are brought into a substantially uniform state, and the wind speed in the lateral direction C of the outlet 53 is brought into a substantially uniform state. In addition, for example, even in a case where the capacity of the passage space of the blower duct 510 is relatively increased, the wind speed in the lateral direction C of the outlet 53 is brought into a substantially uniform state.

Figure 9A:
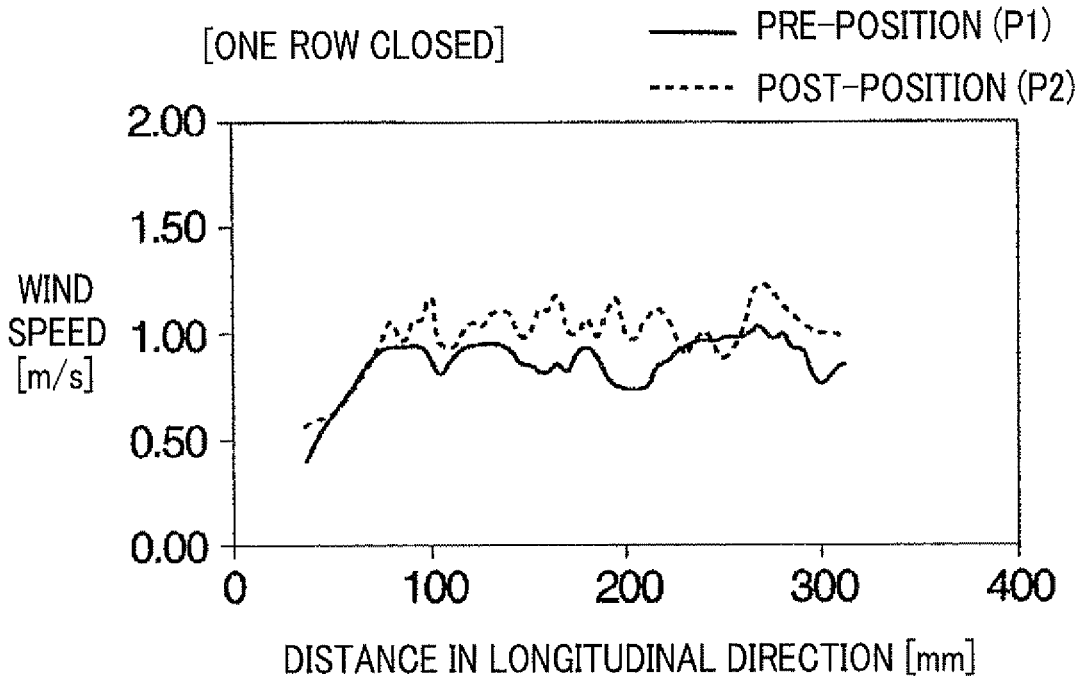
FIGS. 9A to 9C are graphs showing evaluation tests (respective examples in a case where ventilation holes are not formed to one row, two rows, and three rows, respectively) regarding the performance characteristics of the blower duct of FIG. 4.
Figure 9B:
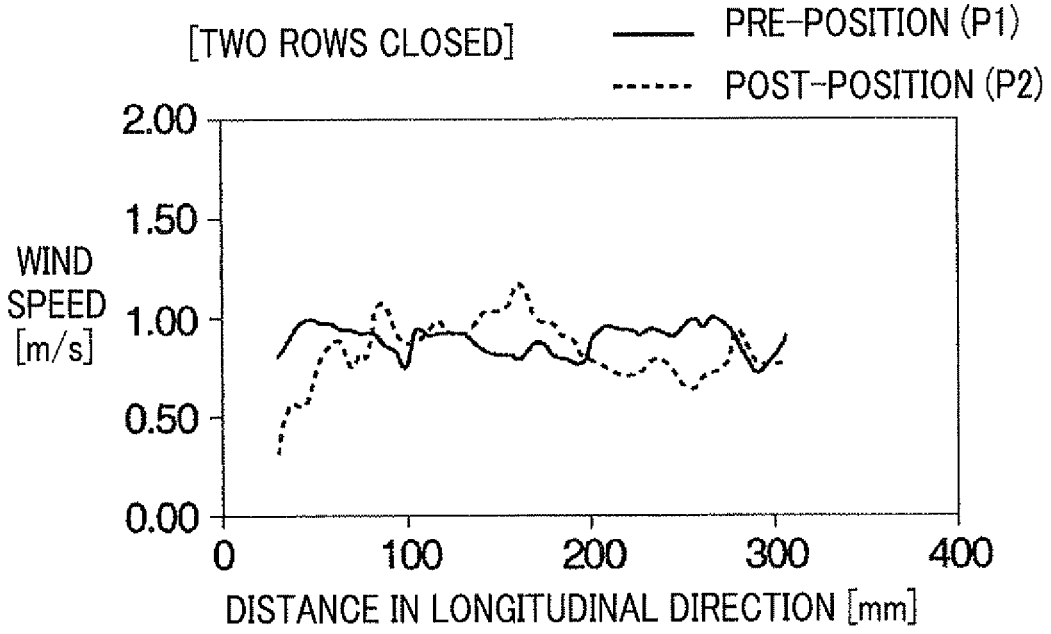
Figure 9C:
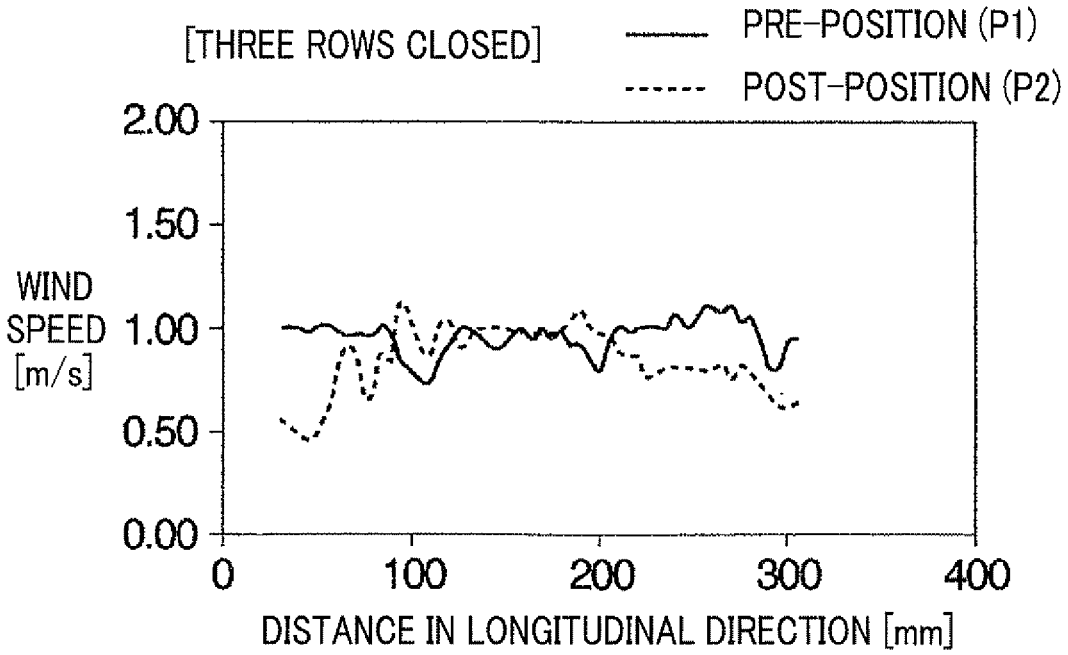

Next, in a case where the respective blower ducts 51 in which the ventilation holes 71 in the permeable member 70 of the outlet suppressing part 62 are not formed in some end regions, and the permeability is adjusted is used, the measurement results become the results as shown in FIGS. 9A to 9C and FIGS. 10B and 10C, respectively. The measurement results in cases where the ventilation holes 71 are not formed up to the first row, the second row, and the third row, respectively (one row closed, two rows closed, and three rows closed) are as follows. That is, as shown in FIGS. 9A to 9C, compared to the measurement results (FIG. 10A) of the blower duct 510 of the reference standard example, the wind speed at the post-position P2 and the wind speed at the pre-position P1 are brought into a substantially uniform state, and the wind speed in the lateral direction C of the outlet 53 is brought into a substantially uniform state.

Figure 10B:
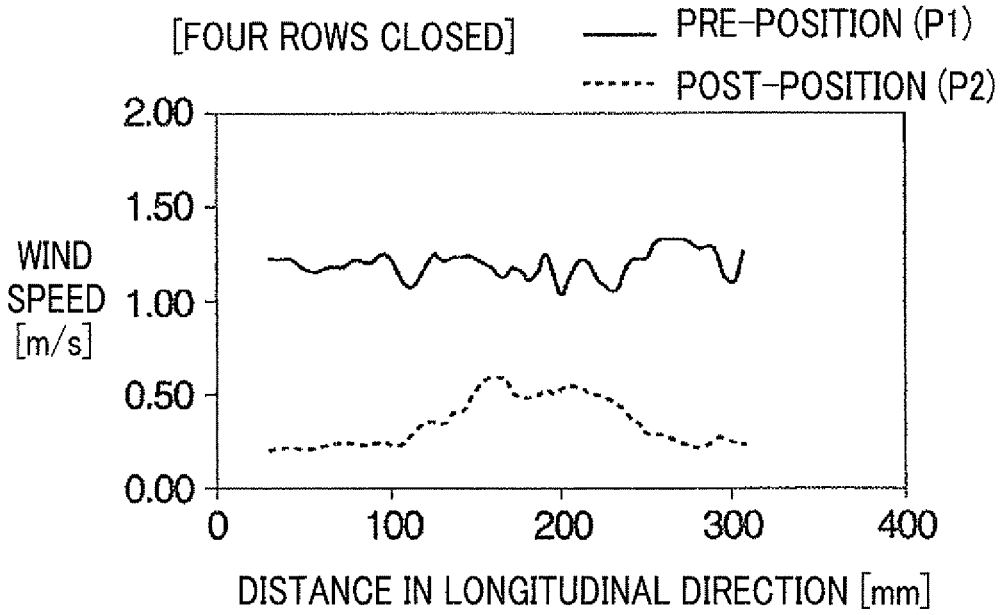
Figure 10C:
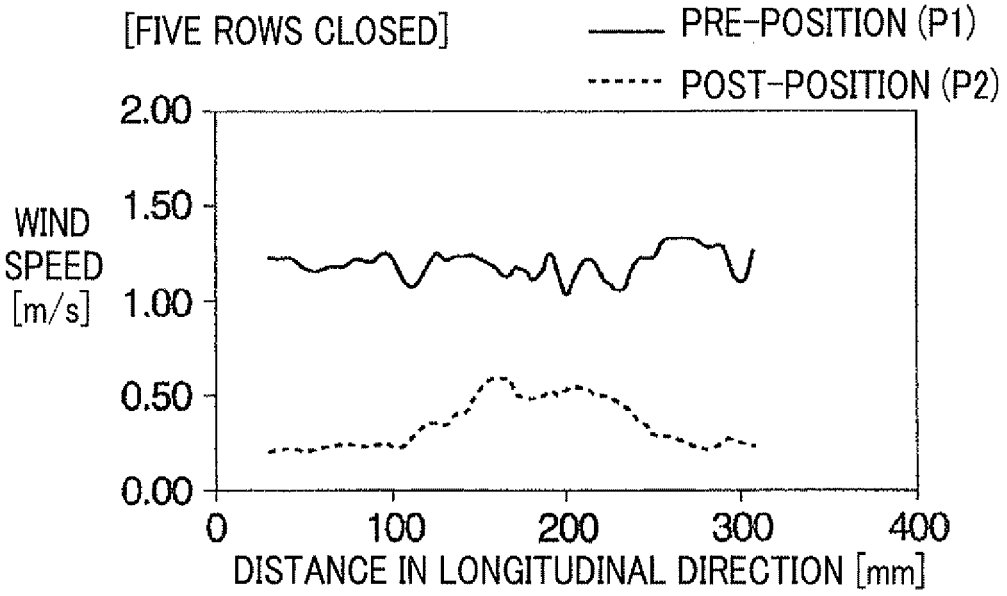

In contrast, the measurement results in cases where the ventilation holes 71 are not formed up to the fourth row and the fifth row, respectively (four rows closed and five rows closed) are as follows. That is, as shown in FIGS. 10B to 10C, compared to the measurement results (FIG. 10A) of the blower duct 510 of the reference standard example, the wind speed at the post-position P2 and the wind speed at the pre-position P1 are brought into a non-uniform state, and the wind speed in the lateral direction C of the outlet 53 is brought into a non-uniform state. It is recognized from these results that there is a tendency for, if the region where the ventilation holes 71 are not formed is increased, the wind speed in the lateral direction C of then outlet 53 to be brought into a more non-uniform state with the increase.

Figure 11:
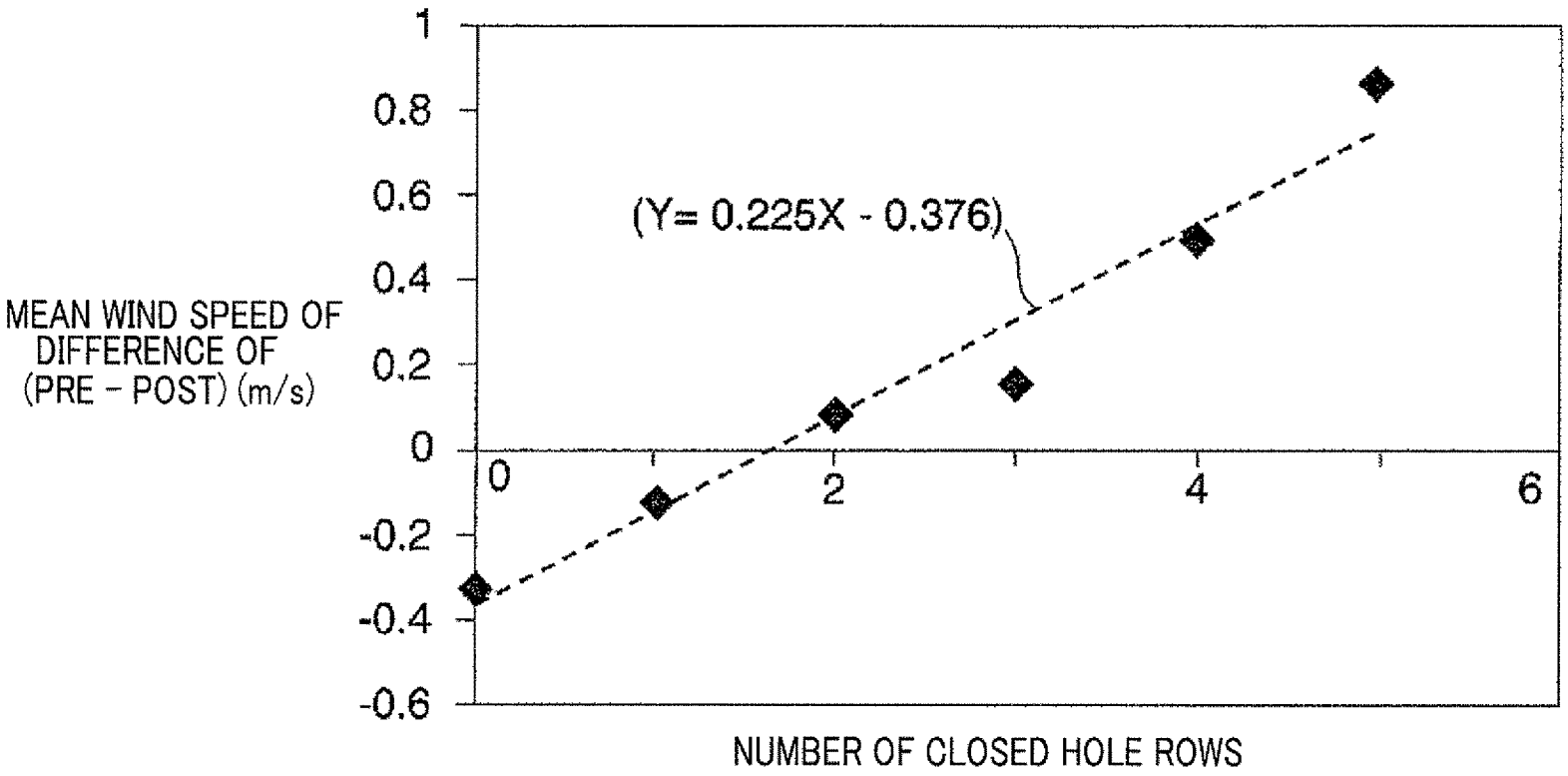
FIG. 11 is a graph showing results (mean wind speed of the difference obtained by subtracting the wind speed at a post-position from the wind speed at a pre-position) obtained by totalizing the measurement results of FIGS. 9A to 9C and FIGS. 10A to 10C.

FIG. 11 shows values obtained by subtracting the wind speed at the post-position P2 from the wind speed at the pre-position P1 (mean wind speed of a difference), with respect to the measurement results shown in FIGS. 9A to 9C and FIGS. 10A to 10C. It may be understood from these results that, as for the permeable member 70 that constitutes the outlet suppressing part 62, relatively excellent results are obtained in a case where the ventilation holes 71 are not formed up to the first row, the second, and the third row, respectively, and the permeability is reduced, and most excellent results are obtained particularly in a case where the ventilation holes are not up to the second row and the permeability is reduced (FIG. 9B).

Modification of Exemplary Embodiment 1

In the exemplary embodiment 1, the blower duct 51 of the blowing device 5 may also be changed to blower ducts that adopt other aspects illustrated below as the aspect in which the permeability in the end region 70*a* of the permeable member 70 that constitutes the outlet suppressing part 62 is reduced more than the permeability of the other region (ventilation non-adjustment region) 70*b*.

Figure 12A:
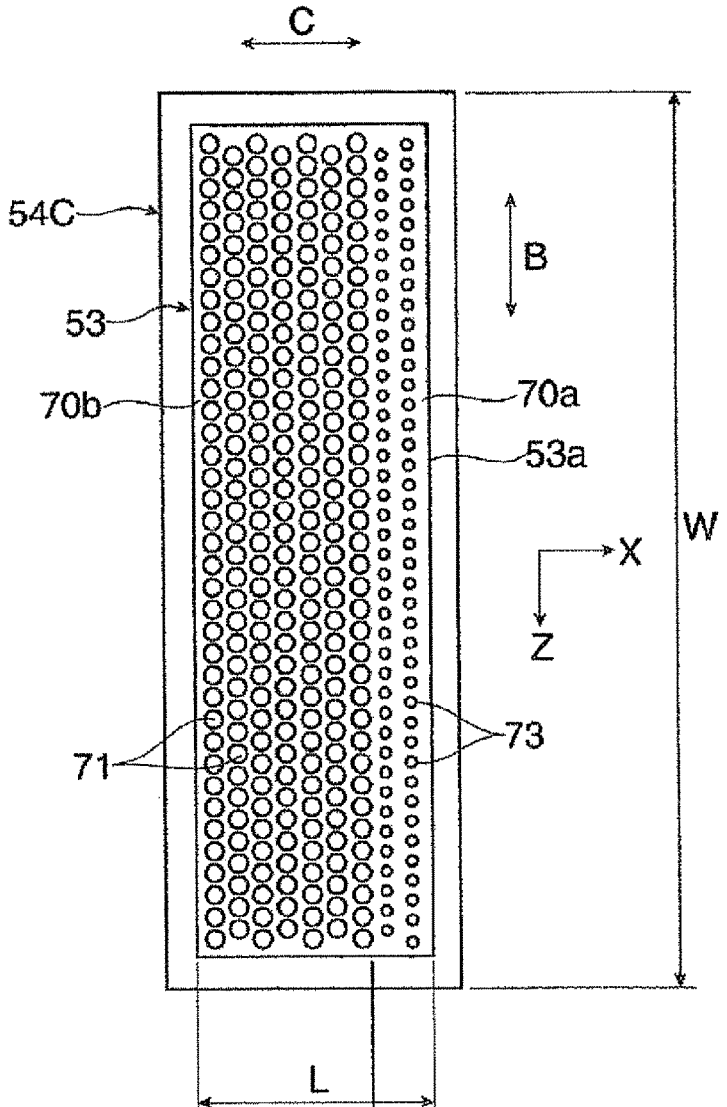
FIGS. 12A and 12B are a plan view and a cross-sectional view showing another configuration example of the end region that reduces the permeability of the permeable member that constitutes the outlet suppressing part (aspect in which ventilation holes are formed with the opening area of the holes being made small)
Figure 12B:
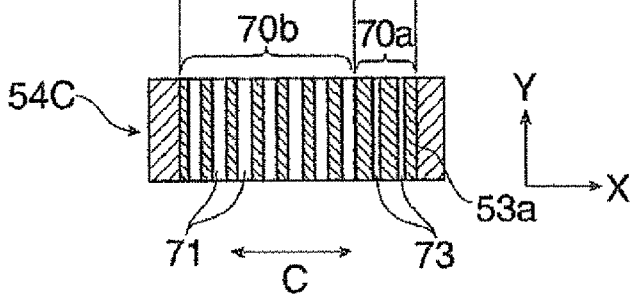

A configuration example shown in FIGS. 12A and 12B is an aspect in which the end region 70*a* is formed with ventilation holes 73 with a smaller diameter (or smaller opening area) than the hole diameter of the ventilation holes 71 instead of the ventilation holes 71 formed in the other region 70*b*. In this case, there is an advantage that the control degree of the wind speed of air that comes out from the end region 70*a* may be finely adjusted compared to the configuration (aspect in which the permeability is set to zero) of the exemplary embodiment 1.

Figure 13A:
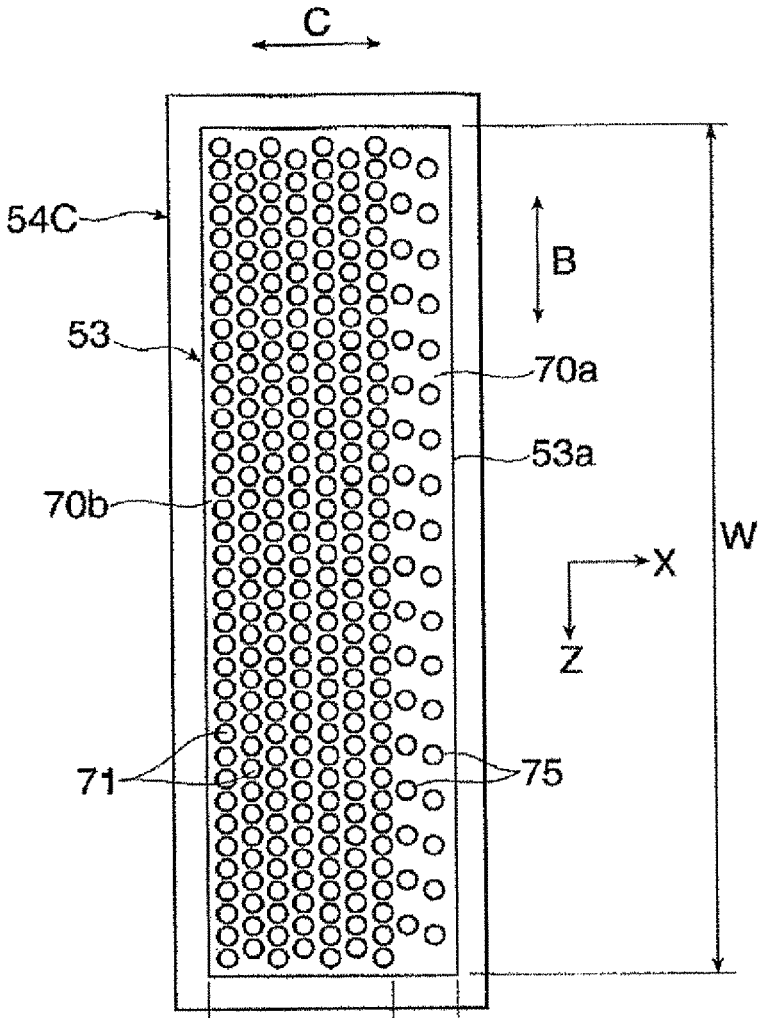
FIGS. 13A and 13B are a plan view and a cross-sectional view showing still another configuration example of the end region that reduces the permeability of the permeable member that constitutes the outlet suppressing part (aspect in which ventilation holes are thinned and formed)
Figure 13B:
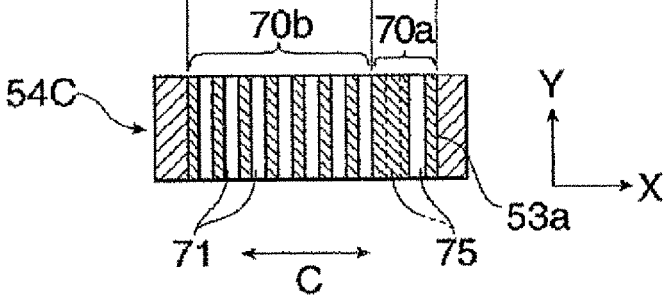

The configuration example shown in FIGS. 13A and 13B is an aspect in that the end region 70*a* is formed with ventilation holes 75 on the condition that the density (the number of holes per unit area) in which the ventilation holes 71 are formed is made small, instead of the ventilation holes 71 formed in the other region 70*b*. In the ventilation holes 75 of the configuration example shown in FIGS. 13A and 13B, the ventilation holes 71 of each example is formed on the condition that the ventilation holes are thinned out every other hole. In this case, for example, there is the same advantage as the advantage acquired in the configuration example shown in the above-described FIGS. 12A and 125.

Figure 14:
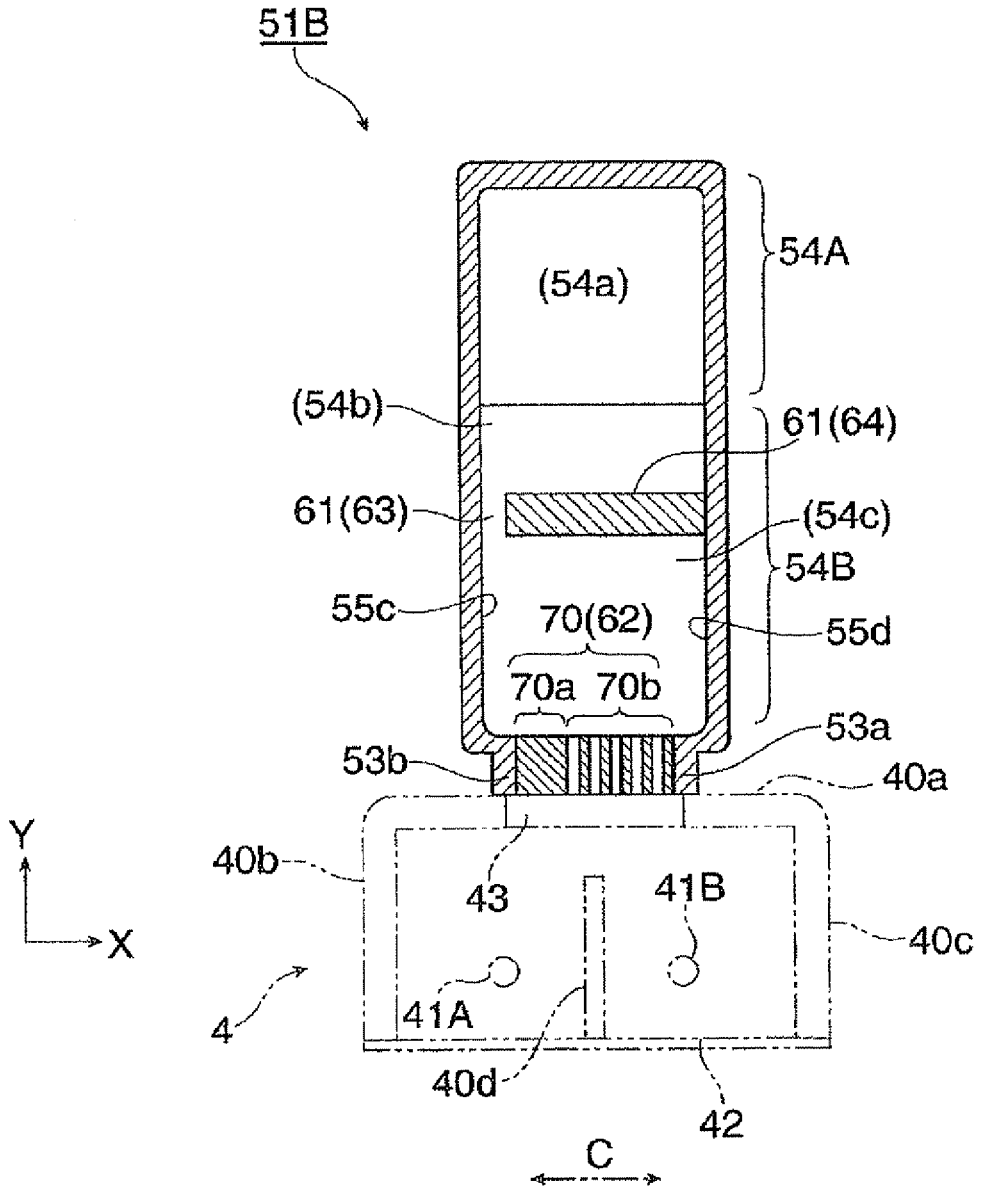
FIG. 14 is a cross-sectional view showing another configuration example of the blower duct.

Additionally, in the exemplary embodiment 1, as the blower duct 51 of the blowing device 5, it is also possible to apply a blower duct 51B that has no second bending passage portion 54C (refer to FIG. 4 or the like) and that is constituted by only the introduction passage part 54A and the first bending passage portion 54B, for example, as shown in FIG. 14. In the blower duct 51B, an outlet 53 having an opening shape somewhat narrower than the cross-sectional shape of the passage space 54*a* of a termination end is formed at the termination end (lower face portion) that extends in the shape of a straight line in the perpendicular direction (direction that is mostly parallel to the axis of coordinates Y) so as to come close to the charging device 4 from the end portion of the first bending passage portion 54B while the width of passage space remains the same.

In the blower duct 51B, the first upstream suppressing part 61 and the outlet suppressing part 62 (refer to FIG. 4 or the like) in the exemplary embodiment 1 are provided, and the permeability in the end region 70*a* of the permeable member 70 that constitutes the outlet suppressing part 62 is made lower than the permeability of the other region 70*b*. The end region 70*a* is a region present at the other one end 53*b* of the outlet 53 in the lateral direction C. The other one end 53*b* of the outlet 53 in the lateral direction C is an end nearer the end position of the inner wall portion 55*c* where the gap 63 of the first upstream suppressing part 61 is present as shown in FIG. 14. In addition, for the one end of the outlet 53 in the lateral direction C may also include the end 53*a*, for example, in a case where the wind speed of air that comes out from the end 53*a* nearer the end position of an inner wall portion 55*d* that faces the inner wall portion 55*c* where the gap 63 of the first upstream suppressing part 61 of the blower duct 51B is present is relatively strong.

In the blowing device 5 to which the blower duct 51B is applied, if the evaluation test regarding the above-mentioned performance characteristics is performed, almost the same excellent results as those in the case where the blower duct 51 in the exemplary embodiment 1 is applied (FIGS. 9A to 9C) are obtained.

Other Embodiments

Although the case where two suppressing parts 61 and 62 are provided as plural suppressing parts that in the blower duct 51 of the blowing device 5 is shown in the exemplary embodiment 1, three or more suppressing parts may be provided. Additionally, it is preferable to provide suppressing parts other than the outlet suppressing part 62 in a part whose cross-sectional shape is changed in the passage space 54*a* of the passage part 54 of the duct 51 or in a part after (immediately after or the like) the direction in which air is caused to flow in the passage space 54*a* is changed.

Although the case where the outlet suppressing part 62 is constructed using the permeable member 70 formed so that the plural ventilation portions (through holes) 71 are almost uniformly dotted with is illustrated in the exemplary embodiment 1, the outlet suppressing part 62 may also be constructed using the permeable member 70 represented by, for example, porous members (in which the plural ventilation portions 71 are irregular through-gaps), such as a nonwoven fabric applied to filters. Incidentally, in a case where the above-described porous member is applied as the permeable member 70 is incidentally applied, the measurement of the permeability of the permeable member 70 may be performed, for example, according to the "Frazier Type Measuring Method of Evaluating The Permeability of Fabric (Nonwoven Fabric Or The Like)" on the basis of L1096 of Japanese Industrial Standard (JIS). Specifically, the permeability of the end region 70*a* may be obtained by using a Frazier type air permeability tester or the like, measuring the permeability in the end region 70*a* and the other region 70*b* of the permeable member 70 that constitutes the outlet suppressing part 62, respectively, and obtaining a ratio (percentage) to the permeability of the region 70*b* other than the end region.

Additionally, as the blower duct 51, blower ducts having other shapes without being limited to the case in which the overall shapes are those illustrated in the exemplary embodiment 1 or the like may be applied. For example, the blower ducts 510 (510A to 510C) illustrated to FIGS. 15A to 15D may be also applied.

Moreover, the charging device 4 to which the blowing device 5 is applied may be a charging device of a type in which the grid electrode 24 is not installed, a so-called corotron type charging device. Additionally, the charging device 4 may be charging devices using one corona discharge wire 41 or three or more corona discharge wires. Additionally, as the long target structure to which the blowing device 5 is applied, a corona discharger that performs neutralization of the photosensitive drum 21 or the like, or a corona discharger that charges or neutralizes charged member other than the photosensitive drum may be used. In addition, a long structure that requires blowing-off of air other than the corona discharger may be used.

Additionally, an image forming method or the like is not particularly limited if the image forming apparatus 1 includes the long target structure that needs to apply the blowing device 5 that adopted the blower duct 51 or the like or the corona discharger 4 equipped with the blowing device 5. If necessary, an image forming apparatus that forms an image formed from materials other than developer may be used.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A blower pipe, comprising:

an inlet that takes in air;

an outlet that has an opening shape different from an opening shape of the inlet;

a passage part, wherein air entering the inlet passes through the passage part and to the outlet;

a first suppressing member oriented on the passage part and oriented further upstream, in an airflow direction, than the outlet, wherein the first suppressing member suppresses an airflow flowing through a passage space of the passage part;

a second suppressing member having a first area and a second area, wherein the second suppressing member is a permeable member, wherein the second suppressing member is disposed so as to shield the outlet and suppress an airflow at the outlet, wherein the second suppressing member comprises a perforated plate having a plurality of through holes disposed within the first area, wherein the second area is an area disposed along a longitudinal direction of the opening of the outlet and is placed in a position in a lateral direction of the opening of the outlet in which airflow is relatively faster, the second area being in a location where airflow is faster relative to the first area, and wherein a permeability of the second area is lower than that of the first area.

2. The blower pipe according to claim 1, wherein the passage part further comprises a bending part, the second suppressing member is downstream, in the airflow direction, of the bending part, the first suppressing member is upstream, in an airflow direction, of the bending part, and the second area is placed within the outlet, and inside of an outside part of the bending part.

3. The blower pipe according to claim 1, wherein a length of the second area is between 5-20% of a length of the second suppressing member as measured along the lateral direction of the outlet.

4. The blower pipe according to claim 2, wherein a length of the second area is between 5-20% of a length of the second suppressing member as measured along the lateral direction of the outlet.

5. A blower device comprising:

a blower that supplies air; and an inlet that takes in air from the blower;

an outlet that has an opening shape different from an opening shape of the inlet;

a passage part, wherein air entering the inlet passes through the passage part and to the outlet;

a first suppressing member oriented on the passage part and oriented further upstream, in an airflow direction, than the outlet, wherein the first suppressing member suppresses an airflow flowing through a passage space of the passage part;

a second suppressing member having a first area and a second area, wherein the second suppressing member is a permeable member, wherein the second suppressing member is disposed so as to shield the outlet and suppress an airflow at the outlet, wherein the second suppressing member comprises a perforated plate having a plurality of through holes disposed within the first area, wherein the second area is an area disposed along a longitudinal direction of the opening of the outlet and is placed in a position in a lateral direction of the opening of the outlet in which airflow is relatively faster, the second area being in a location where airflow is faster relative to the first area, and wherein a permeability of the second area is lower than that of the first area.

6. The blower device according to claim 5, wherein the passage part further comprises a bending part, the second suppressing member is downstream, in the airflow direction, of the bending part, the first suppressing member is upstream, in an airflow direction, of the bending part, and the second area is placed within the outlet, and inside of an outside part of the bending part.

7. The blower device according to claim 5, wherein a length of the second area is between 5-20% of a length of the second suppressing member as measured along the lateral direction of the outlet.

8. The blower device according to claim 6, wherein a length of the second area is between 5-20% of a length of the second suppressing member as measured along the lateral direction of the outlet.

9. An image forming apparatus comprising:

a blower device comprising:

a blower that supplies air; and an inlet that takes in air from the blower;

an outlet that has an opening shape different from an opening shape of the inlet;

a passage part, wherein air entering the inlet passes through the passage part and to the outlet;

a first suppressing member oriented on the passage part and oriented further upstream, in an airflow direction, than the outlet, wherein the first suppressing member suppresses an airflow flowing through a passage space of the passage part;

a second suppressing member having a first area and a second area, wherein the second suppressing member is a permeable member, wherein the second suppressing member is disposed so as to shield the outlet and suppress an airflow at the outlet, wherein the second suppressing member comprises a perforated plate having a plurality of through holes disposed within the first area, wherein the second area is an area disposed along a longitudinal direction of the opening of the outlet and is placed in a position in a lateral direction of the opening of the outlet in which airflow is relatively faster, the second area being in a location where airflow is faster relative to the first area, and wherein a permeability of the second area is lower than that of the first area; and a corona discharger that is placed facing the outlet of the blower pipe and along a longitudinal direction of the opening of the outlet.

10. The image forming apparatus according to claim 9, wherein the passage part further comprises a bending part, the second suppressing member is downstream, in the airflow direction, of the bending part, the first suppressing member is upstream, in an airflow direction, of the bending part, and the second area is placed within the outlet, and inside of an outside part of the bending part.

11. The image forming apparatus according to claim 9, wherein a length of the second area is between 5-20% of a length of the second suppressing member as measured along the lateral direction of the outlet.

12. The image forming apparatus according to claim 10, wherein a length of the second area is between 5-20% of a length of the second suppressing member as measured along the lateral direction of the outlet.

* * * * *